US011352787B2

(12) United States Patent
Amend

(10) Patent No.: US 11,352,787 B2
(45) Date of Patent: Jun. 7, 2022

(54) CONCRETE FORM PANEL, AND CONCRETE FORMWORK COMPRISING SAME

(71) Applicant: Victor Amend, Toronto (CA)

(72) Inventor: Victor Amend, Toronto (CA)

( * ) Notice: Subject to any disclaimer, the term of this patent is extended or adjusted under 35 U.S.C. 154(b) by 0 days.

(21) Appl. No.: 16/444,246

(22) Filed: Jun. 18, 2019

(65) Prior Publication Data

US 2020/0399913 A1 Dec. 24, 2020

(51) Int. Cl.
*E04B 2/86* (2006.01)

(52) U.S. Cl.
CPC ..... *E04B 2/8647* (2013.01); *E04B 2/8605* (2013.01)

(58) Field of Classification Search
CPC ..... E04B 2/8647; E04B 2/8605
USPC ..... 249/40, 47; 428/158, 167; 52/366, 376, 52/422, 426, 427, 440, 441, 364, 309.2, 52/309.7, 309.16, 801.11
See application file for complete search history.

(56) References Cited

U.S. PATENT DOCUMENTS 3,222,697 A * 12/1965 Scheermesser ..... A47C 27/144 428/160
3,401,494 A * 9/1968 Anderson ..... E04F 13/0803 52/309.2
3,782,049 A * 1/1974 Sachs ..... E04B 2/26 52/309.9
4,516,372 A * 5/1985 Grutsch ..... E04B 2/8617 52/309.12
4,860,515 A * 8/1989 Browning, Jr. ..... E04B 2/40 52/426
4,879,855 A * 11/1989 Berrenberg ..... E04B 2/8617 52/309.11
4,901,494 A * 2/1990 Miller ..... E04B 2/8647 249/216
4,967,528 A * 11/1990 Doran ..... E04B 2/8647 52/309.12
5,369,926 A * 12/1994 Borland ..... E04D 11/02 428/158
5,390,459 A * 2/1995 Mensen ..... E04B 2/8617 52/426
5,459,971 A * 10/1995 Sparkman ..... E04B 2/8617 52/105
5,511,346 A * 4/1996 Kenworthy ..... E02D 31/02 405/43
5,566,518 A * 10/1996 Martin ..... E04B 2/8652 52/309.17
5,598,675 A * 2/1997 Pruss ..... E04B 2/8617 52/309.4

(Continued)

FOREIGN PATENT DOCUMENTS

CA 2294823 A1 * 1/1999 ..... E04B 2/8635
DE 2111730 A1 * 12/1972 ..... E04B 2/8647

(Continued)

*Primary Examiner* — Michael Safavi
(74) *Attorney, Agent, or Firm* — Renner, Kenner, Greive, Bobak, Taylor & Weber

(57) ABSTRACT

A concrete form panel for a concrete formwork includes: a foam body having a concrete-facing surface and an outward-facing surface opposite the concrete-facing surface, the outward-facing surface having a plurality of slots formed therein; and a plurality of structural elements. Each structural element is accommodated in a respective slot, and has apertures formed therein for accommodating ties.

19 Claims, 18 Drawing Sheets

(56) References Cited

U.S. PATENT DOCUMENTS 5,611,183 A * 3/1997 Kim ..... E04B 2/845 52/357
5,625,989 A * 5/1997 Brubaker ..... E04B 2/54 249/40
5,657,600 A * 8/1997 Mensen ..... E04C 1/40 52/426
5,709,060 A * 1/1998 Vaughan ..... E04B 2/54 52/426
5,735,093 A * 4/1998 Grutsch ..... E04B 2/8635 52/309.11
5,792,552 A * 8/1998 Langkamp ..... B32B 13/12 428/309.9
5,845,449 A * 12/1998 Vaughan ..... E04B 2/54 52/565
6,026,629 A * 2/2000 Strickland ..... E04C 2/06 52/309.11
6,378,260 B1 * 4/2002 Williamson ..... E04B 2/8617 52/309.12
6,401,413 B1 * 6/2002 Niemann ..... E04B 2/8623 52/309.11
6,408,594 B1 * 6/2002 Porter ..... E04B 7/22 52/220.1
6,698,157 B1 * 3/2004 Porter ..... E04C 2/22 52/309.2
6,892,507 B1 * 5/2005 Pease ..... E04B 1/80 52/269
7,024,833 B1 * 4/2006 Rice ..... E04B 2/8647 52/426
7,543,419 B2 * 6/2009 Rue ..... E04C 2/22 52/309.16
7,827,752 B2 * 11/2010 Scherrer ..... E04B 2/8641 52/426
8,037,652 B2 * 10/2011 Marshall ..... E04B 2/8635 52/309.11
8,136,248 B2 * 3/2012 Beavers, Jr. ..... E04B 1/14 29/897.3
8,438,792 B2 * 5/2013 Schwartz ..... E04B 5/12 52/92.2
8,616,520 B2 * 12/2013 Baader ..... E04B 2/8647 249/40
8,627,629 B2 * 1/2014 Tims ..... E04B 2/26 52/426
8,826,617 B2 * 9/2014 Endo ..... E04C 2/296 52/309.7
8,978,325 B2 * 3/2015 Lewis ..... E04C 2/521 52/220.2
8,997,420 B2 * 4/2015 Amend ..... E04B 5/19 52/426
9,976,299 B2 * 5/2018 Power ..... E04B 1/7076
10,480,188 B2 * 11/2019 Power ..... E04B 1/7645
2001/0002528 A1 * 6/2001 Fust, III ..... E04B 2/8652 52/422
2002/0148181 A1 * 10/2002 Friesner ..... B28B 11/042 52/293.3
2002/0178676 A1 * 12/2002 Yost ..... E04B 2/8635 52/426
2005/0223669 A1 * 10/2005 Cymbala ..... E04C 1/41 52/426
2007/0199266 A1 * 8/2007 Geilen ..... E04C 2/205 52/309.12
2008/0022619 A1 * 1/2008 Scherrer ..... E04B 2/8641 52/407.5
2008/0022621 A1 * 1/2008 Franco ..... E04C 2/04 52/422
2008/0236084 A1 * 10/2008 Pontarolo ..... E04B 2/8641 52/426
2008/0271401 A1 * 11/2008 Grypeos ..... E04B 2/8652 52/426
2010/0236173 A1 * 9/2010 Pacha ..... B32B 17/06 52/309.11
2010/0251651 A1 * 10/2010 Mahe ..... E04G 21/26 52/426
2011/0268912 A1 * 11/2011 Bowman ..... E04C 2/044 428/99
2012/0131870 A1 * 5/2012 deMaere ..... E04B 2/8635 52/309.4
2014/0033627 A1 * 2/2014 Stephens, Jr. ..... E04C 2/28 52/204.5
2014/0272311 A1 * 9/2014 Schwartau ..... B29C 53/063 428/167
2015/0218805 A1 * 8/2015 Jensen ..... E04G 13/021 52/309.4

FOREIGN PATENT DOCUMENTS

DE 2203396 A1 * 8/1973 ..... E04B 2/8647
DE 2255810 A1 * 5/1974 ..... E04B 2/8647
DE 9305329 U1 * 6/1993 ..... E04B 2/8647
DE 102007005351 * 8/2008 ..... E04B 2/8611
GB 2505894 * 3/2014 ..... E04B 1/161
JP 2011117241 * 6/2011 ..... E04B 2/8647
WO WO-9300494 A1 * 1/1993 ..... E04G 9/05
WO WO-2017171111 A1 * 10/2017 ..... E04B 2/8647

* cited by examiner

CONCRETE FORM PANEL, AND CONCRETE FORMWORK COMPRISING SAME

FIELD

The subject application generally relates to forms for concrete walls and in particular, to a concrete form panel and a concrete formwork comprising the same.

BACKGROUND

In the field of building and construction, formwork for constructing concrete walls consists of two spaced arrays of panels, typically fabricated of plywood, that are connected by rods, trusswork or other connecting structure. More recently, it has become desirable to use insulating material such as expanded polystyrene (EPS) for the formwork, in order to provide thermal and acoustic insulation to the finished concrete wall.

Concrete formworks comprising insulating material have been previously described. For example, U.S. Pat. No. 4,426,061 to Taggart describes a method and apparatus for forming insulated walls by pouring concrete directly on a form made in part of insulating material which will remain in place after the concrete sets. An apparatus for spacing the sheets of insulating material from the sheets of other material to create a concrete form is also described. The apparatus provides the function of bridging adjacent sheets of insulating material to create an adequate seal for the concrete.

In some applications, once the concrete has been poured and has set, it is desirable to remove or "strip" the formwork to expose the finished concrete surface. In some cases, portions of the formwork can adhere to the finished concrete surface, creating imperfections on the concrete surface.

Improvements are generally desired. It is therefore at least an object to provide a novel concrete form panel, and a concrete formwork comprising the same.

SUMMARY

It should be appreciated that this summary is provided to introduce a selection of concepts in a simplified form that are further described below in the detailed description. This summary is not intended to be used to limit the scope of the claimed subject matter.

Accordingly, in one aspect, there is provided a concrete form panel for a concrete formwork, the concrete form panel comprising: a foam body having a concrete-facing surface and an outward-facing surface opposite the concrete-facing surface, the outward-facing surface having a plurality of slots formed therein; and a plurality of structural elements, each structural element being accommodated in a respective slot, each structural element having apertures formed therein for accommodating ties.

Each slot may extend: at least a portion of the height of the foam body, or at least a portion of the length of the foam body. Each slot may extend the height or the length of the foam body.

Each structural element may be bonded by adhesive to the foam body. Each structural element may embedded in the foam body, the structural element being accessible from the outward-facing surface. Each structural element may engage the foam body by interference fit.

Each structural element may be sized to have an outward-facing surface that is flush with the outward-facing surface of the foam body.

Each structural element may be sized such that it protrudes beyond the outward-facing surface of the foam body. Each structural element may have an outward-facing surface that is offset from the outward-facing surface of the foam body. Each structural element may have a plurality of additional apertures formed in sidewalls thereof, the additional apertures defining a plurality of ventilation passages through the structural element. Each structural element may have an additional aperture formed in each sidewall thereof, the additional apertures defining a single ventilation passage through the structural element.

Each structural element may comprise at least one layer of corrugated material. Each layer of corrugated material may comprise a sinusoidal or zig-zag configuration of sheet material disposed between two generally planar sheets of sheet material. Corrugations of the at least one layer of corrugated material may define a plurality of ventilation passages through the structural element.

The concrete form panel may further comprise a film disposed on the concrete-facing surface. An interfacial strength between the film and the foam body may be greater than the adhesive strength between the film and set concrete. The film may be a film of plastic. The concrete form panel may further comprise an adhesive layer disposed between the film and the foam body.

The foam body may have a first lateral surface and a second lateral surface, the first and second lateral surfaces either having connecting features formed therein or the first and second lateral surfaces being generally planar. The foam body may have a top surface and a bottom surface, the top and bottom surfaces either having connecting features formed therein or the top and bottom surfaces being generally planar.

The concrete form panel may further comprise additional slots formed at edges of the outward-facing surface, each additional slot being sized to accommodate a portion of one of the structural elements.

In another aspect, there is provided a concrete formwork, comprising: a plurality of panels defining spaced, opposing sides of the formwork, at least some of the panels being concrete form panels each comprising: a foam body having a concrete-facing surface and an outward-facing surface opposite the concrete-facing surface, the outward-facing surface having a plurality of slots formed therein, and a plurality of structural elements, each structural element being accommodated in a respective slot, and each structural element having apertures formed therein for accommodating ties; and a plurality of ties accommodated by the structural elements and connecting the panels of the opposing sides of the formwork.

The panels defining both sides of the formwork may be the concrete form panels.

The panels defining a first side of the formwork may be the concrete form panels, and the panels defining a second side of the formwork are hardboard sheets. The hardboard sheets may be selected from the group consisting of: OSB (oriented strand board), plywood, fiber cement board, and cement board.

The ties may be fastened to the structural elements by fasteners, each fastener selected from the group consisting of: a threaded nut; a threaded hemispherical fastener; a clip; and a pin.

In another aspect, there is provided a method of forming a concrete wall, comprising: stacking a plurality of panels to define spaced, opposing sides of a formwork, at least some of the panels being concrete form panels each comprising: a foam body having a concrete-facing surface and an outward-facing surface opposite the concrete-facing surface, the outward-facing surface having a plurality of slots formed therein, and a plurality of structural elements, each structural element being accommodated in a respective slot, and each structural element having apertures formed therein for accommodating ties; connecting opposing panels with a plurality of ties accommodated in the structural elements; and pouring concrete into the volume defined between the opposing sides of the formwork.

The method may further comprise fastening wall finishing materials to outward-facing surfaces of the structural elements.

The connecting may further comprise: fastening the ties to the structural elements using fasteners, each fastener being selected from the group consisting of: a threaded nut; a threaded hemispherical fastener; a clip; and a pin.

BRIEF DESCRIPTION OF THE DRAWINGS

Embodiments will now be described more fully with reference to the accompanying drawings in which.

DETAILED DESCRIPTION OF EMBODIMENTS

The foregoing summary, as well as the following detailed description of certain examples will be better understood when read in conjunction with the appended drawings. As used herein, an element or feature introduced in the singular and preceded by the word "a" or "an" should be understood as not necessarily excluding the plural of the elements or features. Further, references to "one example" or "one embodiment" are not intended to be interpreted as excluding the existence of additional examples or embodiments that also incorporate the described elements or features. Moreover, unless explicitly stated to the contrary, examples or embodiments "comprising" or "having" or "including" an element or feature or a plurality of elements or features having a particular property may include additional elements or features not having that property. Also, it will be appreciated that the terms "comprises", "has", "includes" means "including by not limited to" and the terms "comprising", "having" and "including" have equivalent meanings.

As used herein, the term "and/or" can include any and all combinations of one or more of the associated listed elements or features.

It will be understood that when an element or feature is referred to as being "on", "attached" to, "connected" to, "coupled" with, "contacting", etc. another element or feature, that element or feature can be directly on, attached to, connected to, coupled with or contacting the other element or feature or intervening elements may also be present. In contrast, when an element or feature is referred to as being, for example, "directly on", "directly attached" to, "directly connected" to, "directly coupled" with or "directly contacting" another element of feature, there are no intervening elements or features present.

It will be understood that spatially relative terms, such as "under", "below", "lower", "over", "above", "upper", "front", "back" and the like, may be used herein for ease of description to describe the relationship of an element or feature to another element or feature as illustrated in the figures. The spatially relative terms can however, encompass different orientations in use or operation in addition to the orientation depicted in the figures.

Figure 1:
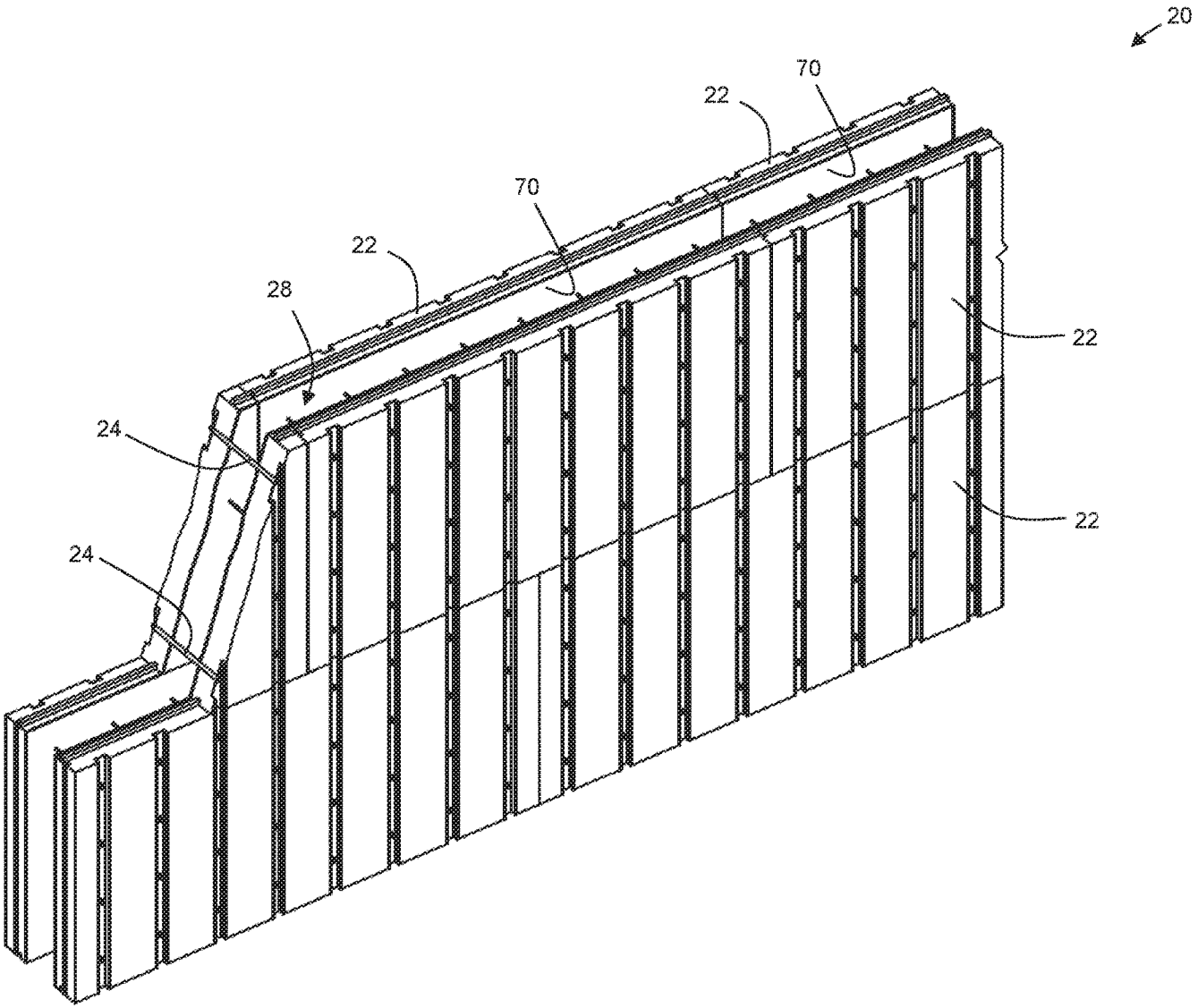
FIG. 1 is a perspective view of a portion of a concrete formwork.
Figure 2:
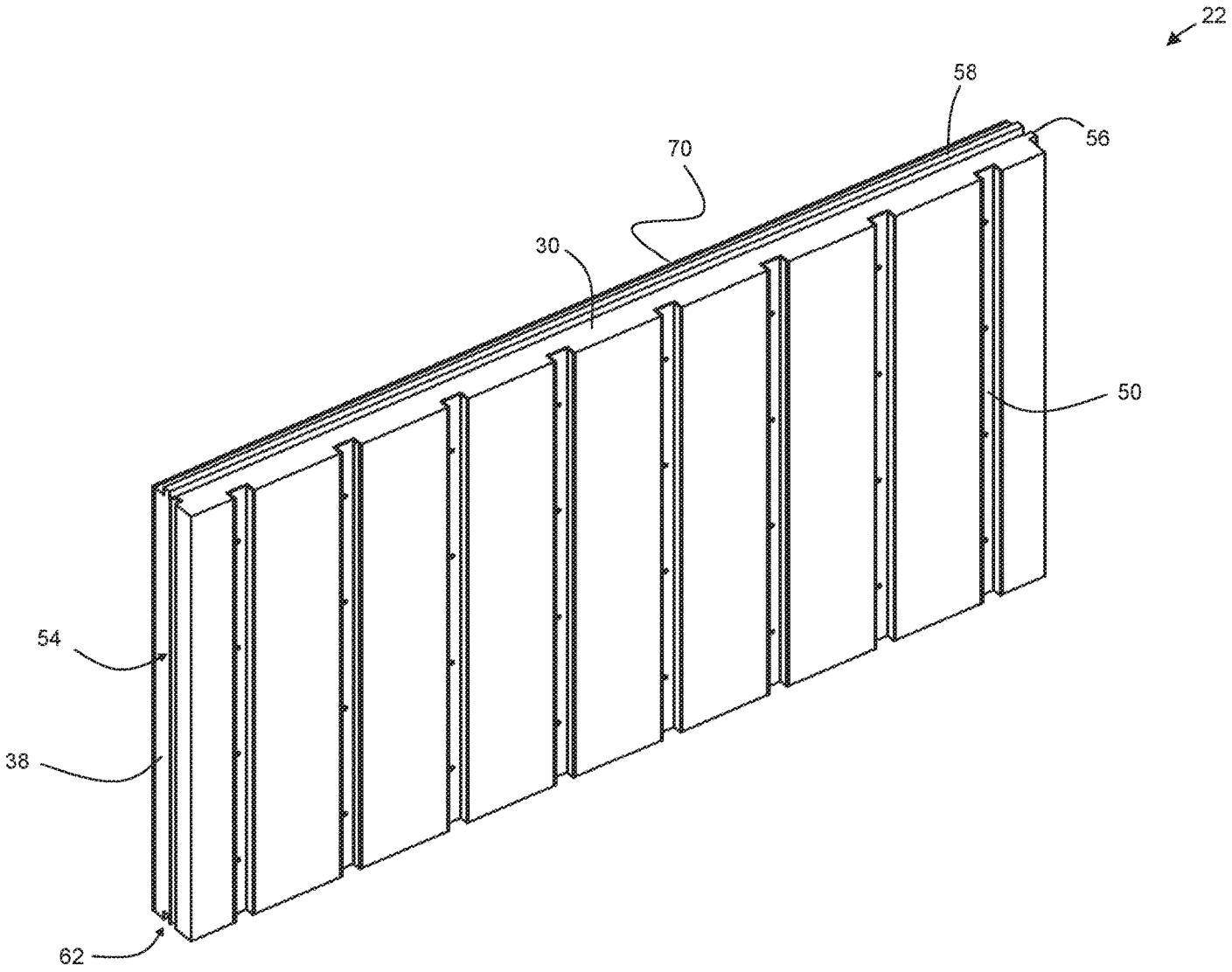
FIG. 2 is a perspective view of concrete form panel forming part of the concrete formwork of FIG. 1.
Figure 3:
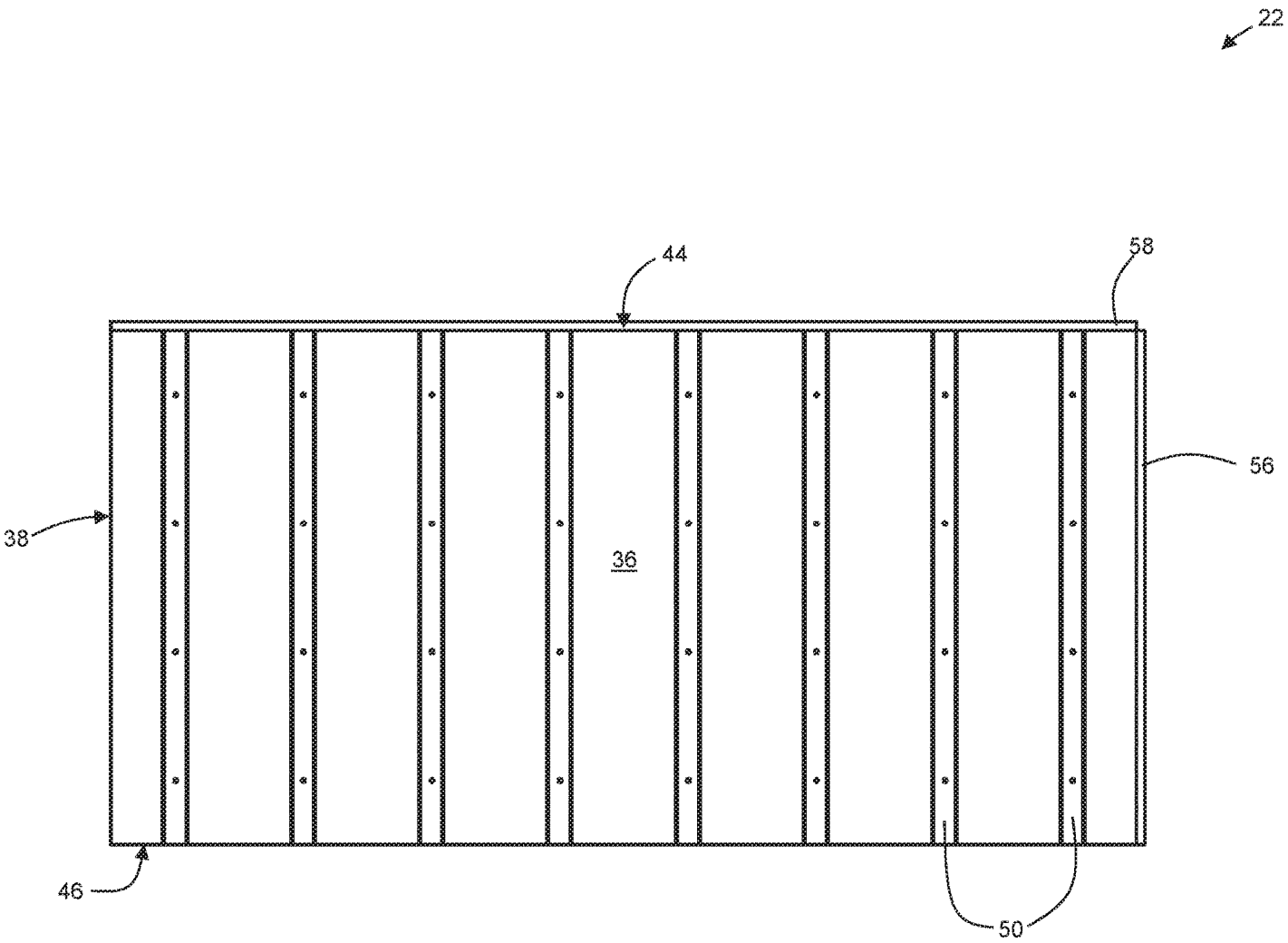
FIG. 3 is a front view of the concrete form panel of FIG. 2.
Figure 5:
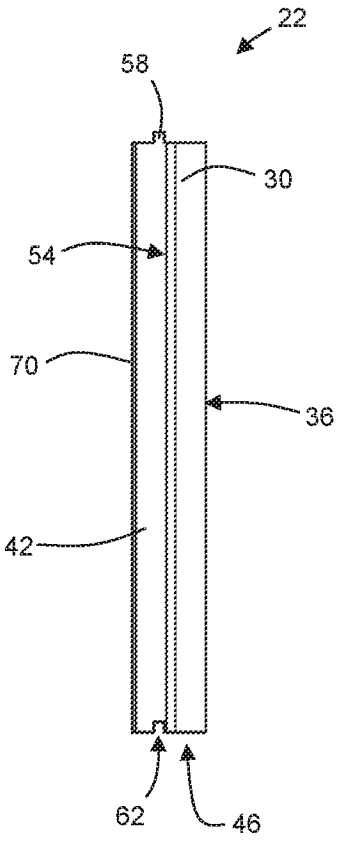
FIG. 5 is a side view of the concrete form panel of FIG. 2.
Figure 4:
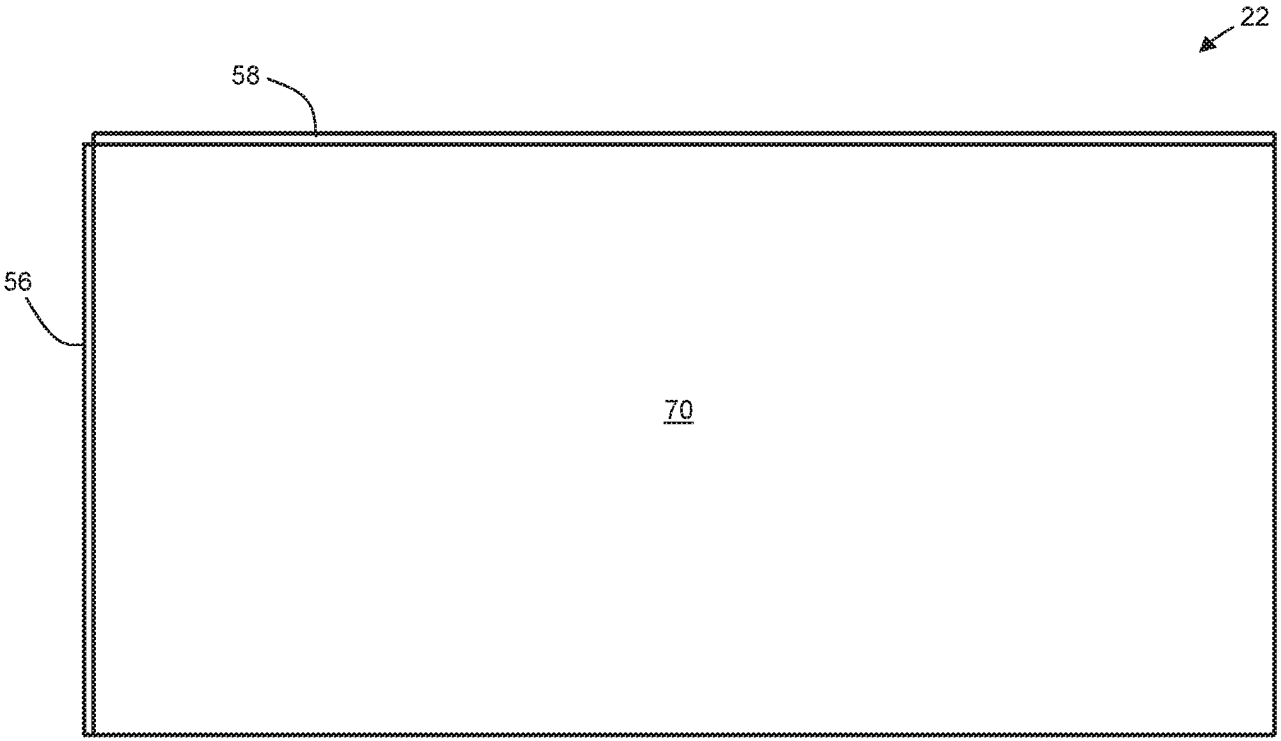
FIG. 4 is a rear view of the concrete form panel of FIG. 2.
Figure 6:
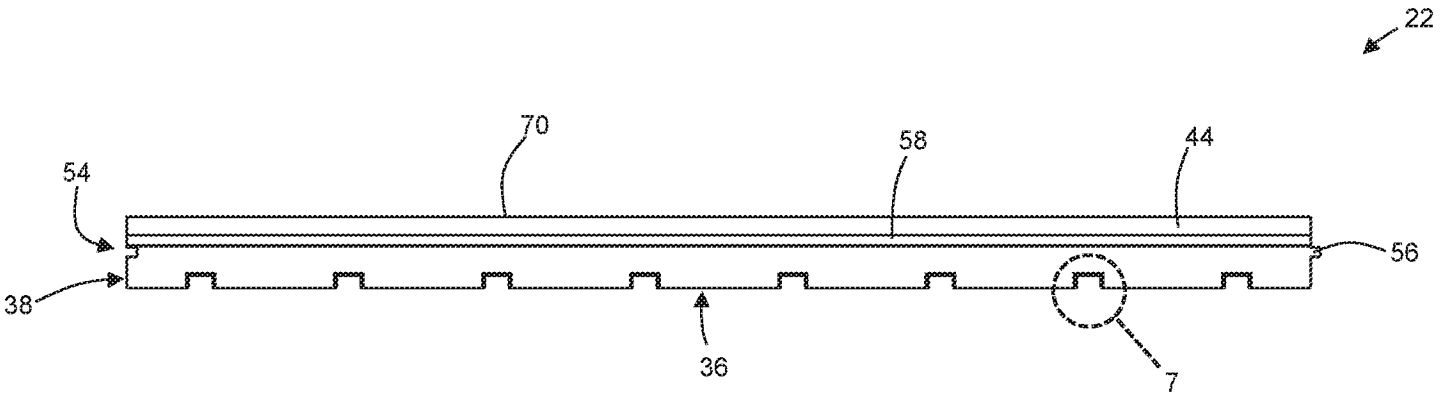
FIG. 6 is a top view of the concrete form panel of FIG. 2.
Figure 7:
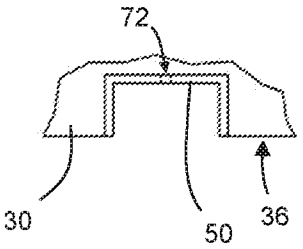
FIG. 7 is an enlarged fragmentary view of the concrete form panel of FIG. 6.
Figure 8:
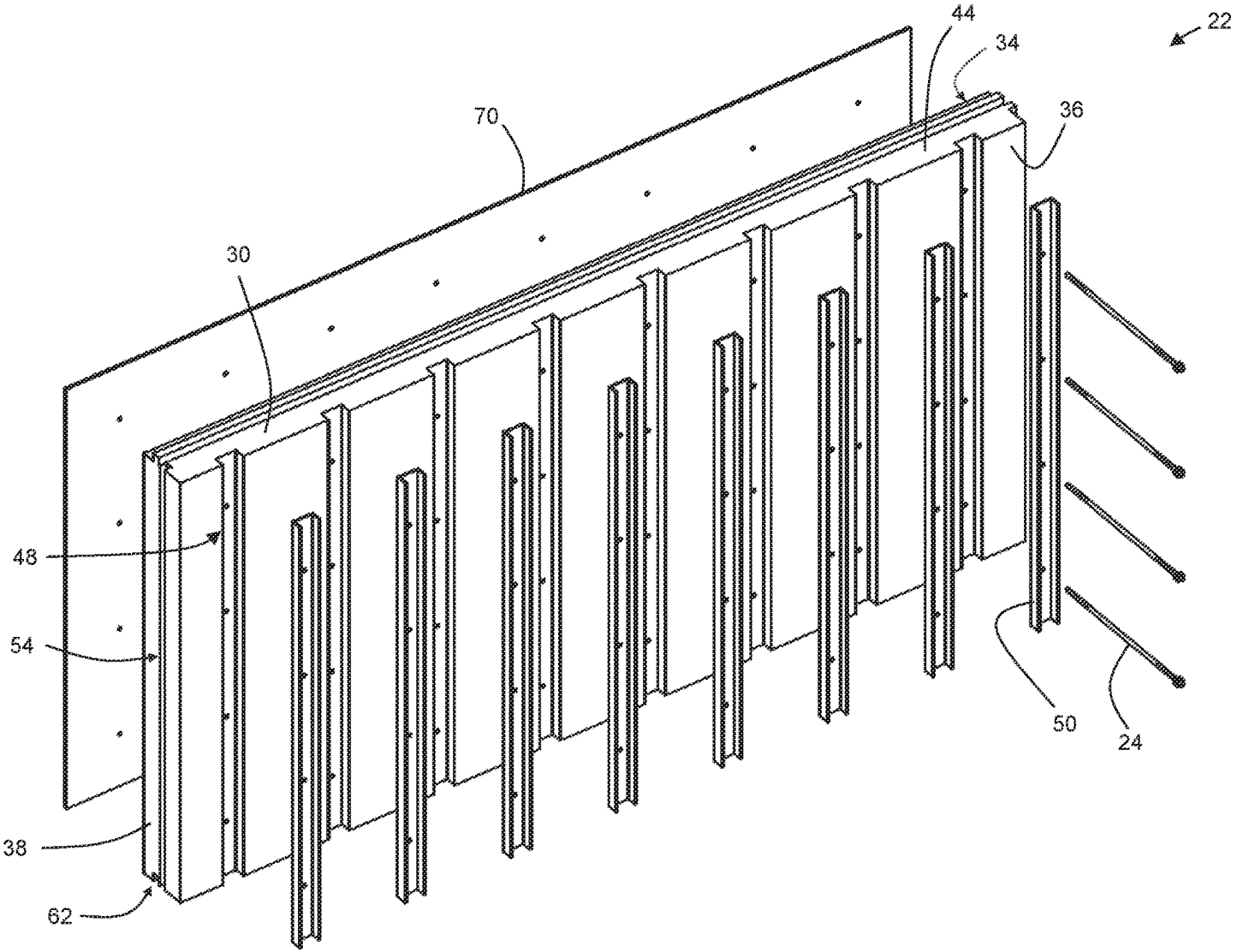
FIG. 8 is an exploded perspective view of the concrete form panel of FIG. 2, and ties for use therewith.

Turning now to FIG. 1, a portion of an assembled concrete formwork is shown and is generally indicated by reference numeral 20. Concrete formwork 20 is configured to serve as a mold into which concrete is poured to form a concrete wall during construction of a building. The building may be a residential building, such as a house, and the concrete wall may be a concrete foundation wall, for example.

The concrete formwork 20 comprises a plurality of concrete form panels 22 that are stacked to form two (2) spaced sides of the concrete formwork, and a plurality of ties 24 connecting opposing concrete form panels 22. When connected by the ties 24, the concrete form panels 22 define a volume 28 into which concrete is to be poured. In the example shown, the concrete form panels 22 are stacked in a staggered arrangement.

The concrete form panel 22 may be better seen in FIGS. 2 to 8. Concrete form panel 22 has a foam body 30 fabricated of insulating foam, and in this embodiment the foam body 30 is fabricated of expanded polystyrene (EPS) foam by molding, whereby expandable polystyrene beads (not shown) are heated in a suitably shaped mold (not shown), as is known in the art. The foam body 30 has a generally planar concrete-facing surface 34, an outward-facing surface 36 opposite the concrete-facing surface 34, a first lateral surface 38, a second lateral surface 42, a top surface 44 and a bottom surface 46. The foam body 30 has a plurality of slots 48 formed in the outward-facing surface 36, with each slot 48 being sized to accommodate a structural element 50. In the example shown, the slots 48 extend the height of the foam body 30, however it will be understood that the slots 48 may alternatively extend the length of the foam body 30.

In this embodiment, the foam body 30 has a plurality of connecting features formed therein for enabling abutting concrete form panels 22 to be connected. In the example shown, the connecting features comprise a groove 54 formed in the first lateral surface 38, a tongue 56 formed on the second lateral surface 42, a tongue 58 formed on the top surface 44, and a groove 62 formed in the bottom surface 46. In the example shown, the foam body 30 has a length of eight (8) feet, a height of four (4) feet and a thickness of six (6) inches, and the slots 48 have a pitch of twelve (12) inches, however it will be understood that the foam body 30 may alternatively be differently dimensioned.

The concrete form panel 22 also comprises a film 70 disposed on the concrete-facing surface 34 of the foam body 30. The film 70 is a film of plastic, such as polypropylene or polyester, and the like. In this embodiment, the film 70 is disposed on the concrete-facing surface 34 during molding of the foam body 30, whereby the film 70 is positioned in the mold, and becomes affixed to the foam body 30 by fusing induced by heating during molding. During use, concrete poured into the volume 28 comes into contact with the film 70 and sets within the concrete formwork 20. The film 70 and the foam body 30 are configured such that the interfacial strength between the film 70 and the foam body 30 is greater than the adhesive strength between the film 70 and the set concrete.

Figure 9B:
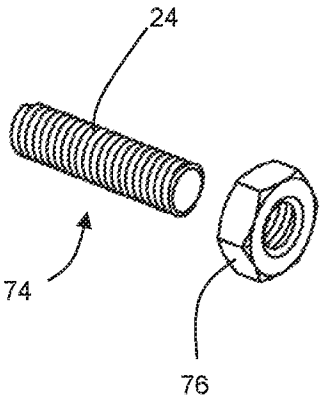
FIG. 9B is an exploded, enlarged fragmentary view of the fastener and a portion of the tie of FIG. 9A.
Figure 9A:
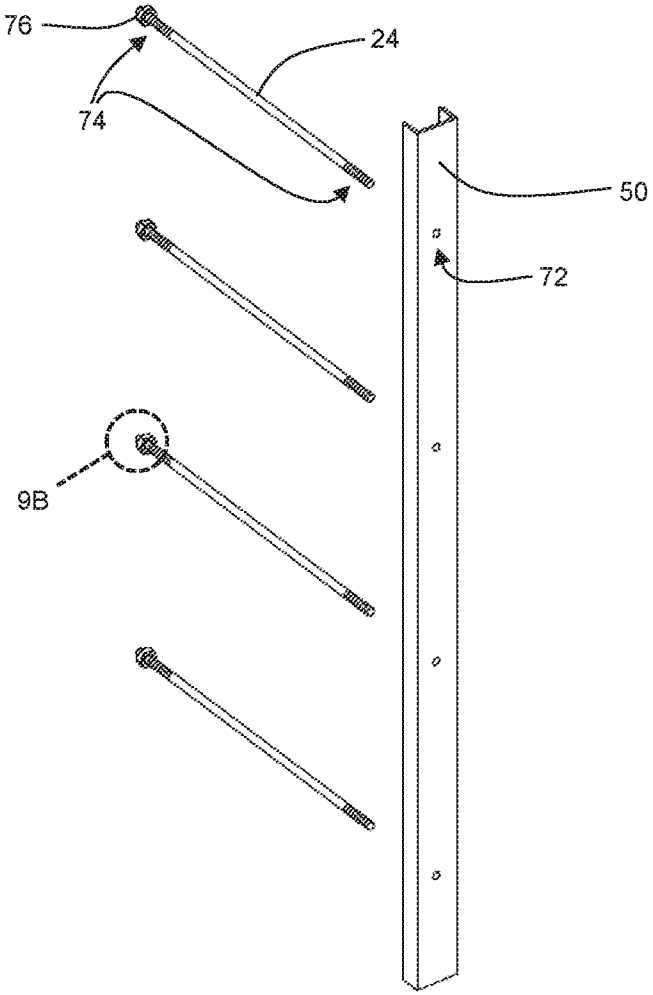
FIG. 9A is a perspective view of a structural element forming part of the concrete form panel of FIG. 2, and ties and fasteners for use therewith.

FIG. 9A shows one of the structural elements 50 and ties 24. Structural element 50 has a generally C-shaped cross section, and has apertures 72 formed therein for accommodating ties 24. The structural element 50 is fabricated of a material having suitable strength, such as steel or another metal, or plastic. In this embodiment, the structural elements 50 are bonded to the slots 48 formed in the foam body 30 by adhesive (not shown), and the structural elements 50 thereby form part of the concrete form panel 22. In the example shown, the structural element 50 has a length of four (4) feet, a width of two (2) inches and a depth of one (1) inch, however it will be understood that the structural element 50 may alternatively be differently dimensioned.

In the example shown, each tie 24 is in the form of a steel rod having threaded ends 74 for each engaging a fastener 76. The fastener 76 may be better seen in in FIG. 9B, and in this embodiment the fastener 76 is a threaded nut.

In use, the concrete formwork 20 is assembled by stacking concrete form panels 22, by engaging tongues 56 and grooves 54 of horizontally-abutting concrete form panels 22, and by engaging tongues 58 and grooves 62 of vertically-abutting concrete form panels 22, so as to form the two (2) spaced, opposing sides of the concrete formwork 20. When arranged in this manner the films 70 of the concrete form panels 22 on opposite sides of the concrete formwork 20 face each other. During stacking of the concrete form panels 22, ties 24 are inserted through opposing concrete form panels 22, such that they pass through apertures 72 of the structural elements 50, and through the foam bodies 30 and the films 70, and such that the ties 24 extend between the opposing concrete form panels 22. Fasteners 76 are then fastened to the threaded ends 74 of the ties 24 to connect the concrete form panels 22, thereby completing assembly of the concrete formwork 20 and defining the volume 28 into which the concrete is to be poured, as shown in FIG. 1.

Figure 10:
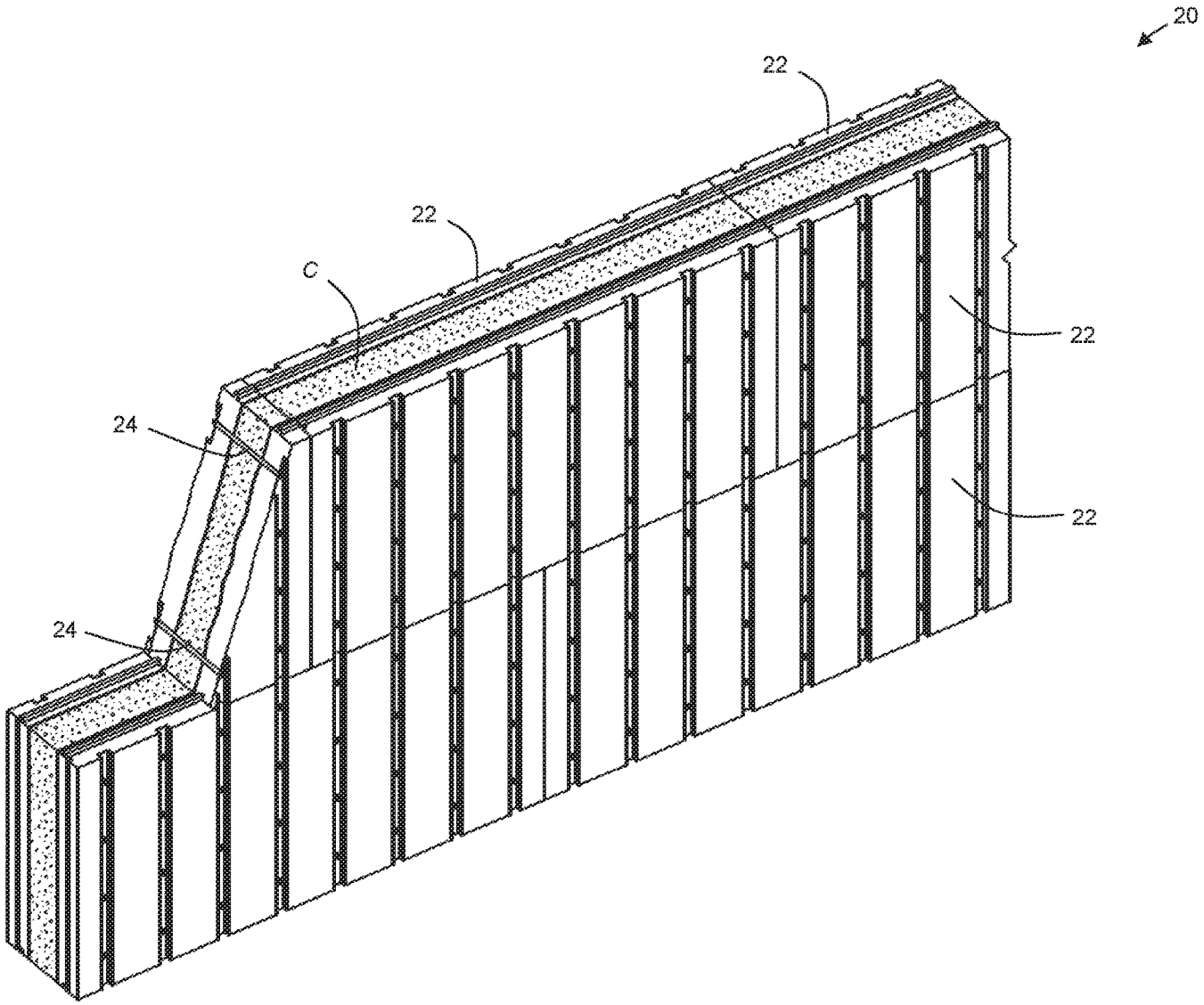
FIG. 10 is a perspective view of the portion of the concrete formwork of FIG. 1, during use.

With the concrete formwork 20 assembled, concrete C is poured into the volume 28 defined between the concrete form panels 22 and is allowed to set, as shown in FIG. 10.

Figure 11:
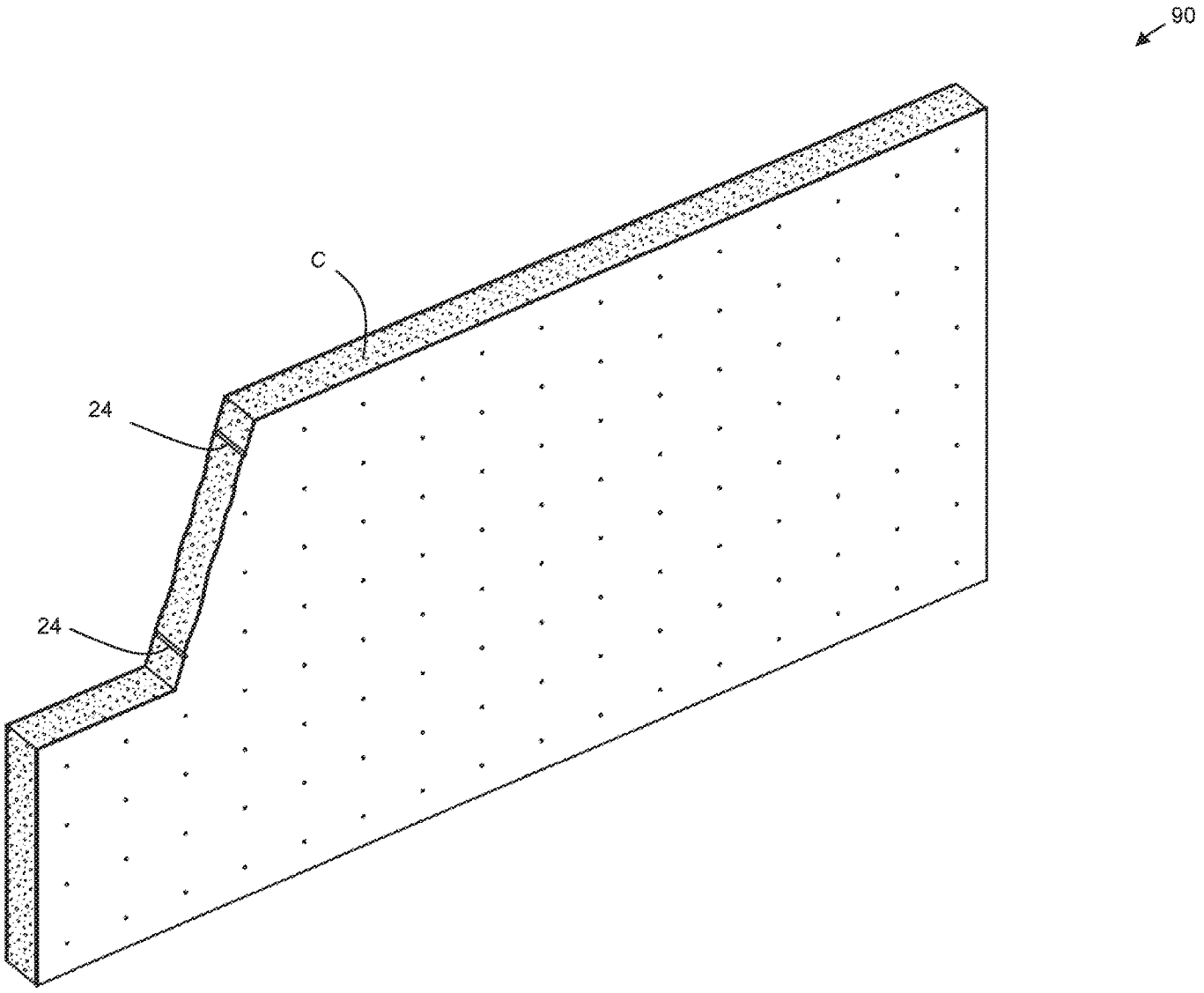
FIG. 11 is a perspective view of a portion of a concrete wall formed using the concrete formwork of FIG. 1.

Once the concrete has set, the fasteners 76 may be removed and the concrete form panels 22 separated from the set concrete C. As the interfacial strength between the film 70 and the foam body 30 is greater than the adhesive strength between the film 70 and the set concrete, the concrete form panel 22 easily separates from the set concrete C, with the film 70 remaining affixed to the foam body 30, resulting in a smooth surface on each side of the set concrete C. Portions of the ties 24 that project from the sides of the set concrete are then cut or cleaved using a suitable tool (not shown) such as a saw or a hammer, resulting in a concrete wall 90 having sides that are generally smooth, as shown in FIG. 11.

Alternatively, once the concrete has set, some or all of the concrete form panels 22 may alternatively not be separated from the set concrete C, and may instead remain in place as desired to provide a layer of insulation on one or both sides of the set concrete C.

As will be appreciated, the film 70 strengthens the foam body 30, and thereby advantageously reinforces the concrete form panel 22.

As will also be appreciated, the film 70 prevents the concrete from adhering to the foam body 30, which advantageously prevents portions of the foam body 30 from breaking off during separation of the concrete from panels 22 and remaining attached to the set concrete C, otherwise creating rough surfaces on the sides of the concrete wall 90.

As will be appreciated, the structural elements 50 provide structural support to the foam body 30 and thereby strengthen the concrete form panel 22, which advantageously reduces the number of ties 24 needed to achieve the necessary structural integrity in the concrete formwork 20, as compared to conventional concrete form panels used in conventional concrete formworks.

Figure 12:
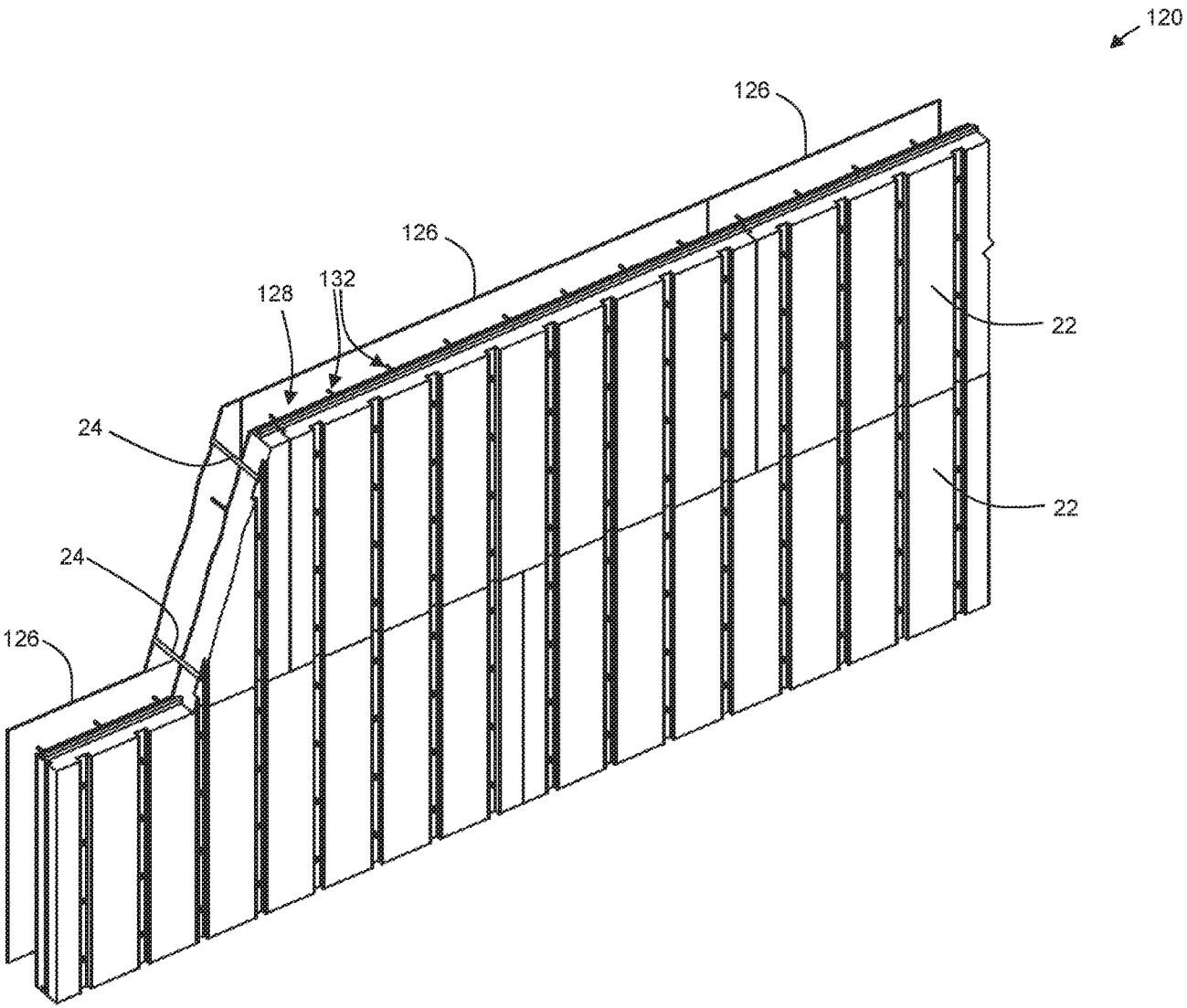
FIG. 12 is a perspective view of a portion of another embodiment of a concrete formwork for use with the concrete formwork of FIG. 1 or FIG. 12.

Other configurations are possible, and in other embodiments the concrete formwork may alternatively be differently configured. For example, FIG. 12 shows another embodiment of a concrete formwork, which is generally indicated by reference numeral 120. Concrete formwork 120 is generally similar to concrete formwork 20 described above and with reference to FIG. 1, and is configured to serve as a mold into which concrete is poured to form a concrete wall during construction of a building.

In this embodiment, concrete formwork 120 comprises a plurality of the concrete form panels 22, which are described above and with reference to FIGS. 2 to 8, that are stacked to form a first side of the concrete formwork 120. The concrete formwork 120 further comprises a plurality of hardboard sheets 126 that are arranged to form a second side of the concrete formwork 120, and a plurality of ties 24 connecting the concrete form panels 22 and the hardboard sheets 126. When connected by the ties 24, the concrete form panels 22 and the hardboard sheets 126 define a volume 128 into which the concrete is to be poured. In the example shown, the concrete form panels 22 are stacked in a staggered arrangement, and the hardboard sheets 126 are arranged in a staggered arrangement.

Each hardboard sheet 126 is a sheet of material selected from the group consisting of OSB (oriented strand board), plywood, fiber cement board, cement board, and the like. The hardboard sheet 126 may alternatively be a sheet of one or more other suitable materials. The hardboard sheets have apertures 132 formed therein that are sized to accommodate the ties 24, and the apertures may be formed at the site of assembly of the concrete formwork 120 or may be formed prior to delivery to the site.

In use, the concrete formwork 120 is assembled by stacking concrete form panels 22, in the manner described above for concrete formwork 20, to form the first side of the concrete formwork 120. Hardboard sheets 126 are arranged to form the second side of the concrete formwork 120. When arranged in this manner, the films 70 of the concrete form panels 22 face the opposing hardboard sheets 126. As the concrete form panels 22 are being stacked and the hardboard sheets 126 are being arranged, ties 24 are inserted through the concrete form panels 22 and the hardboard sheets 126 such that they pass through apertures 72 of the structural elements 50, through the foam bodies 30 and the films 70, and through the apertures 132 of the opposing hardboard sheets 126. Fasteners 76 are then fastened to the threaded ends 74 of the ties 24 to connect the concrete form panels 22 to the hardboard sheets 126, thereby completing assembly of the concrete formwork 120 and defining the volume 128 into which the concrete is to be poured, shown in FIG. 10.

With the concrete formwork 120 assembled, concrete is then poured into the volume 128 defined between the stacked assembly of concrete form panels 22 and the hardboard sheets 126, and is allowed to set.

Once the concrete has set, the fasteners 76 adjacent the hardboard sheets 126 are removed and the hardboard sheets 126 are separated from the set concrete. Portions of the ties 24 that project from the one (1) side of the set concrete are then cut or cleaved using a suitable tool (not shown) such as a saw or a hammer, resulting in a concrete wall having a first side that is generally smooth. The concrete form panels 22 and fasteners remain in place to provide a layer of insulation on the first side of the set concrete.

Figure 13:
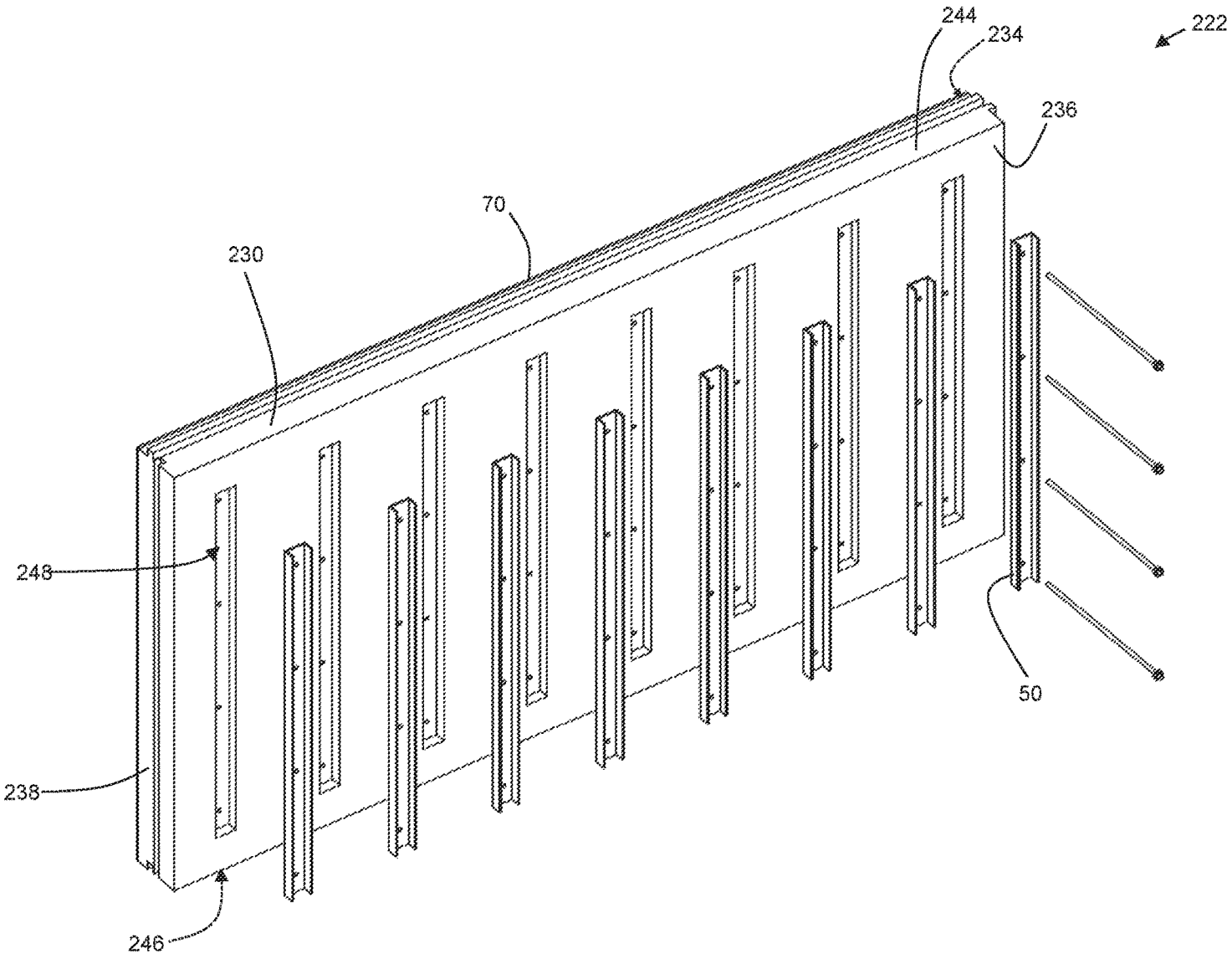
FIG. 13 is a partially exploded, perspective view of another embodiment of a concrete form panel for use with the concrete formwork of FIG. 1 or FIG. 12, and ties for use therewith.

The concrete form panel is not limited to the configuration described above, and in other embodiments the concrete form panel may be differently configured. For example, FIG. 13 shows another embodiment of a concrete form panel for use with the concrete formwork 20 or 120, and which is generally indicated by reference numeral 222. The concrete form panel 222 is generally similar to concrete form panel 22 described above and with reference to FIGS. 2 to 8, and comprises a foam body 230 fabricated of insulating foam. In this embodiment the foam body 230 is fabricated of expanded polystyrene (EPS) foam by molding. The foam body 230 has a generally planar concrete-facing surface 234, an outward-facing surface 236 opposite the concrete-facing surface 234, a first lateral surface 238, a second lateral surface 242, a top surface 244 and a bottom surface 246. The foam body 230 has a plurality of slots 248 formed in the outward-facing surface 236, with each slot 248 being sized to accommodate a structural element 50, which is cut or otherwise formed or shaped to have a suitable length compatible with the length of the slot 248. In this embodiment, the slots 248 do not extend the full height of the foam body 230, but rather extend the majority of the height of the foam body 230. In the example shown, the slots 248 extend about eighty percent (80%) of the height of the foam body 230, however it will be understood that the slots may alternatively be differently dimensioned. The foam body 230 has the plurality of connecting features formed therein for enabling abutting concrete form panels 222 and/or 22 to be connected. The concrete form panel 222 also comprises the film 70 disposed on the concrete-facing surface 234 of the foam body 230. In this embodiment, the film 70 is disposed on the concrete-facing surface 234 during molding of the foam body 230, whereby the film 70 is positioned in the mold and becomes affixed to the foam body 230 during molding. The film 70 and the foam body 230 are configured such that the interfacial strength between the film 70 and the foam body 230 is greater than the adhesive strength between the film 70 and the set concrete.

Although in the embodiment described above, the foam body 230 has a plurality of slots 248 that are oriented along the height of the foam body 230, in other embodiments, the slots may alternatively be oriented along the length of the foam body, and such that they that do not extend the full length of the foam body but rather extend a majority of the length of the foam body 230.

Figure 14:
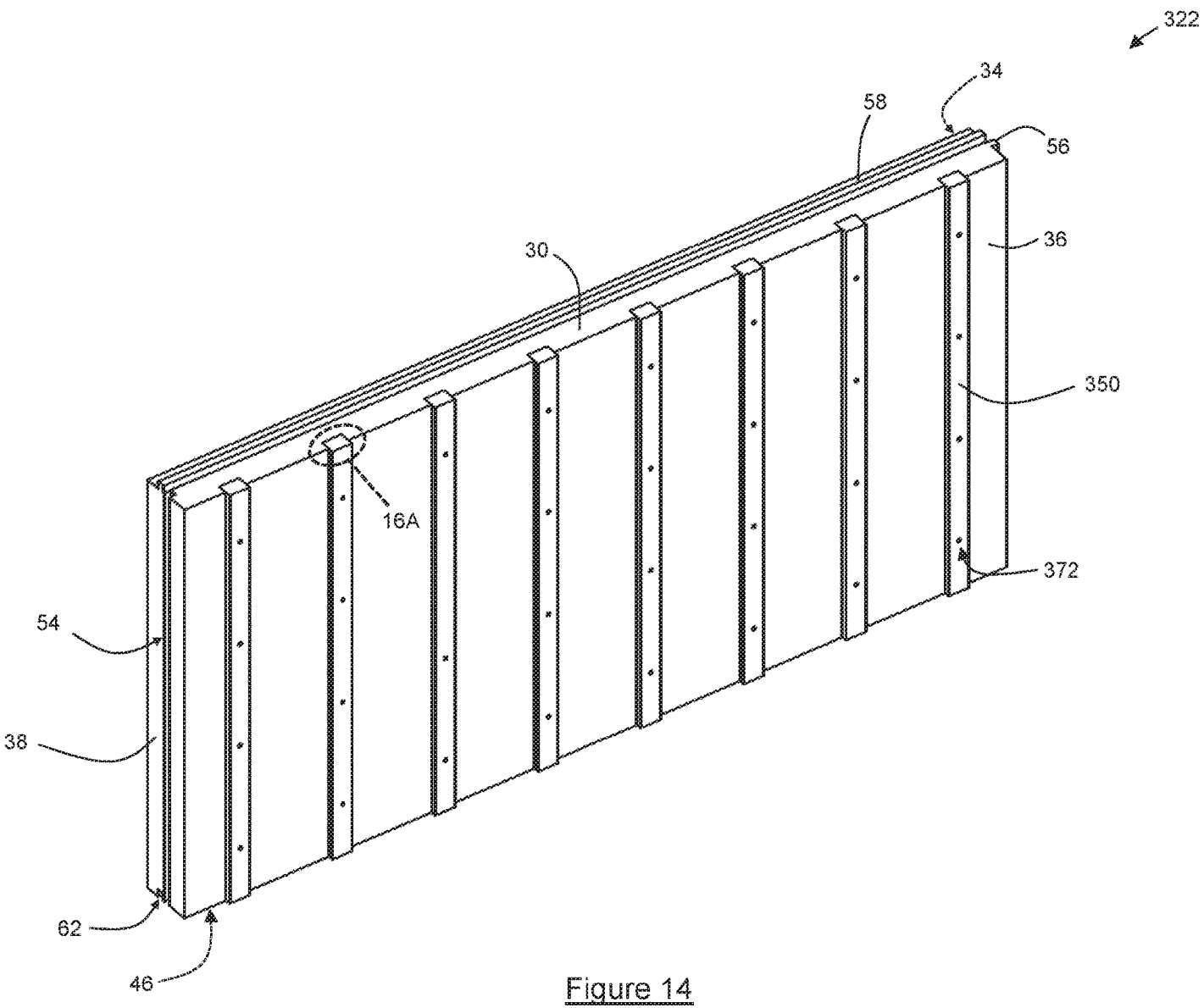
FIG. 14 is a perspective view of still another embodiment of a concrete form panel for use with the concrete formwork of FIG. 1 or FIG. 12.
Figure 15B:
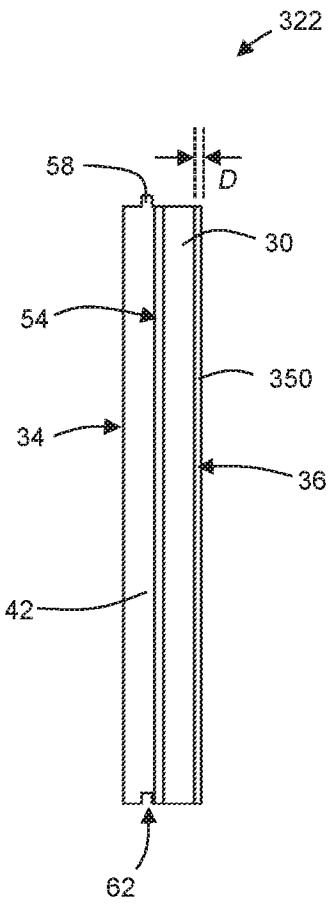
FIGS. 15A and 15B are rear and side views of the concrete form panel of FIG. 14.
Figure 15A:
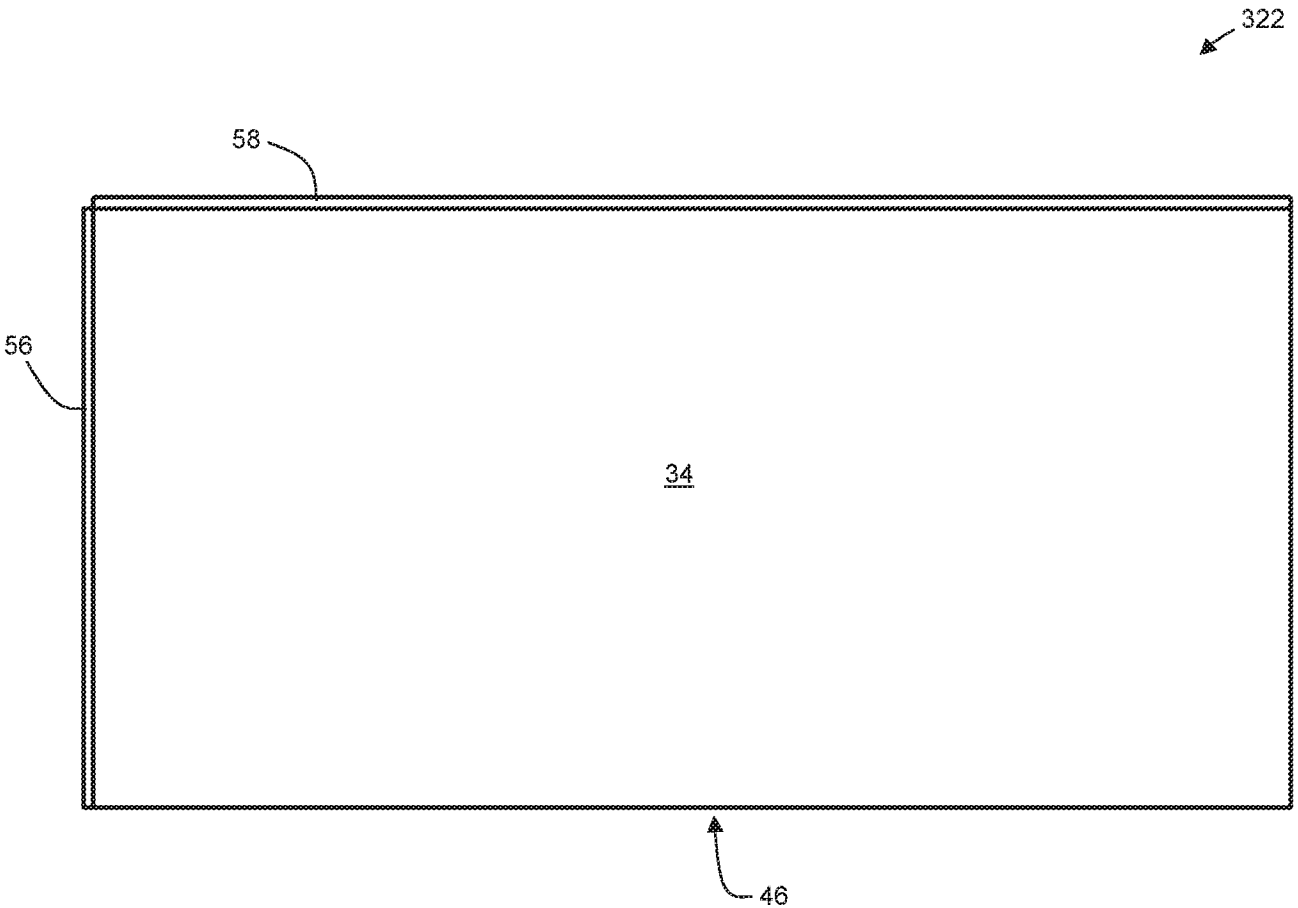

FIGS. 14, 15A and 15B show another embodiment of a concrete form panel for use with the concrete formwork 20 or 120, and which is generally indicated by reference numeral 322. Concrete form panel 322 is similar to concrete form panel 22 described above and with reference to FIGS. 2 to 8, and comprises the foam body 30 fabricated of insulating foam. In this embodiment the foam body 30 is fabricated of expanded polystyrene (EPS) foam by molding. The foam body 30 has the generally planar concrete-facing surface 34, the outward-facing surface 36 opposite the concrete-facing surface 34, the first lateral surface 38, the second lateral surface 42, the top surface 44 and the bottom surface 46. The foam body 30 has the plurality of slots 48 formed in the outward-facing surface 36, with each slot 48 being sized to accommodate a structural element 350. The foam body 30 has the plurality of connecting features formed therein for enabling abutting concrete form panels 22 to be connected. In the example shown, the connecting features comprise the groove 54 formed in the first lateral surface 38, the tongue 56 formed on the second lateral surface 42, the tongue 58 formed on the top surface 44, and the groove 62 formed in the bottom surface 46. In the example shown, the foam body 30 has a length of eight (8) feet, a height of four (4) feet and a thickness of six (6) inches, and the slots 48 have a pitch of twelve (12) inches, however it will be understood that the foam body 30 may alternatively be differently dimensioned.

Unlike concrete form panel 22, concrete form panel 322 does not have a film disposed on the concrete-facing surface 34. Rather, during use, the concrete-facing surface 34 of the foam body strongly adheres to the concrete as the concrete sets in the concrete formwork. Whether the concrete form panel 322 defines the interior surface or the exterior surface of the concrete wall will depend on the positioning of the concrete form panel 322 in the concrete formwork 20 or 120.

Figure 16A:
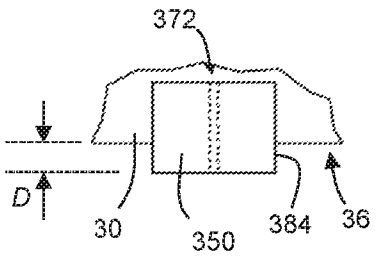
FIG. 16A is an enlarged fragmentary view of the concrete form panel of FIG. 14.

FIG. 16A shows the structural element 350. Structural element 350 has a solid, generally rectangular cross section comprising an outwardly-facing surface 382. The structural element 350 is fabricated of a suitable material such as wood, metal or plastic, and for example high density polyethylene (HDPE), polypropylene (PP) or acrylonitrile butadiene styrene (ABS), and has apertures 372 formed therein for accommodating ties 24.

As will be understood, the outwardly-facing surface 382 structural element 350 provides a fastening surface for exterior or interior wall finishing materials (not shown), such as drywall sheets or siding panels, for example. Additionally, the structural element 350 has a depth, defined by each sidewall 384, that is greater than the depth of the slot 48 formed in the foam body 30.

Owing to the thickness of the structural element 350, when the structural element 350 is accommodated in the slot 48, a portion of the structural element 350 protrudes by a distance D beyond the outward-facing surface 36, as indicated in FIGS. 15B and 16A. As a result, any finishing material (not shown), such as drywall sheets or siding panels, fastened to the structural element 350 will advantageously be spaced from the outward-facing surface 36 of the foam body 30 by a gap corresponding to the distance D. As will be appreciated, this gap advantageously allows for ventilation between the concrete form panel 322 and the finishing material.

As will be appreciated, the use of structural elements 350, which provide fastening surfaces for wall finishing materials, advantageously reduces the amount of labor and cost required to finish the interior and/or exterior of the concrete wall 90, as compared to conventional concrete form panels used in prior art concrete formworks.

Figure 16B:
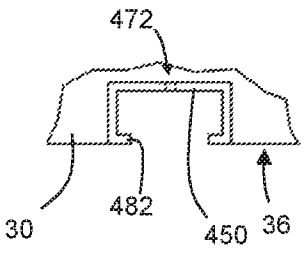
FIGS. 16B to 16K are enlarged fragmentary views of the concrete form panel of FIG. 7, showing other embodiments of structural elements.

In other embodiments, the structural elements may be differently configured. For example, FIG. 16B shows another embodiment of a structural element forming part of the concrete form panel 22, 222 or 322, and which is generally indicated by reference numeral 450. Structural element 450 is generally similar to structural element 50 described above and with reference to FIG. 9A, but has a generally C-shaped cross section comprising inwardly extending flanges 482. As will be understood, the flanges 482 provide fastening surfaces for wall finishing materials (not shown), such as drywall sheets or siding panels. Similar to structural element 50, the structural element 450 has apertures 472 formed therein for accommodating ties 24.

Figure 16C:
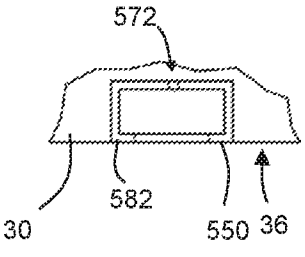

FIG. 16C shows another embodiment of a structural element forming part of the concrete form panel 22, 222 or 322, and which is generally indicated by reference numeral 550. Structural element 550 is generally similar to structural element 50 described above and with reference to FIG. 9A, but has a generally tubular, box-shaped cross section comprising an outwardly-facing surface 582. As will be understood, the outwardly-facing surface 582 provides a fastening surface for wall finishing materials (not shown), such as drywall sheets or siding panels. Similar to structural element 50, the structural element 550 has apertures 572 formed therein for accommodating ties 24.

Figure 16D:
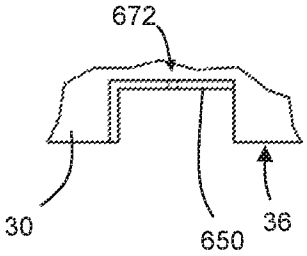

FIG. 16D shows another embodiment of a structural element forming part of the concrete form panel 22, 222 or 322, and which is generally indicated by reference numeral 650. Structural element 650 is generally similar to structural element 50 described above and with reference to FIG. 9A, but has a generally L-shaped cross section. Similar to structural element 50, the structural element 650 has apertures 672 formed therein for accommodating ties 24.

Figure 16E:
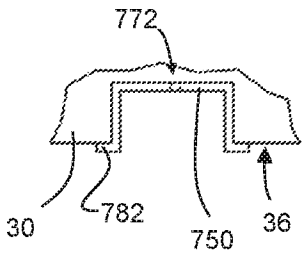

FIG. 16E shows another embodiment of a structural element forming part of the concrete form panel 22, 222 or 322, and which is generally indicated by reference numeral 750. Structural element 750 is generally similar to structural element 50 described above and with reference to FIG. 9A, but has a generally C-shaped cross section comprising outwardly extending flanges 782. As will be understood, the flanges 782 provide fastening surfaces for wall finishing materials (not shown), such as drywall sheets or siding panels. Similar to structural element 50, the structural element 750 has apertures 772 formed therein for accommodating ties 24.

Figure 16F:
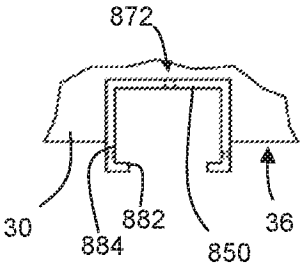

FIG. 16F shows another embodiment of a structural element forming part of the concrete form panel 22, 222 or 322, and which is generally indicated by reference numeral 850. Structural element 850 is generally similar to structural element 50 described above and with reference to FIG. 9A, but has a generally C-shaped cross section comprising inwardly extending flanges 882. As will be understood, the flanges 882 provide fastening surfaces for wall finishing materials (not shown), such as drywall sheets or siding panels. Additionally, the structural element 850 has a depth, defined by each sidewall 884, which is greater than the depth of the slot 48 formed in the foam body 30. When the structural element 850 is accommodated in the slot 48, a portion of the structural element 850 protrudes beyond the outward-facing surface 36. As a result, any finishing material (not shown), such as drywall sheets or siding panels, fastened to the structural element 850 will advantageously be spaced from the outward-facing surface 36 of the foam body 30. Similar to structural element 50, the structural element 850 has apertures 872 formed therein for accommodating ties 24.

Figure 16H:
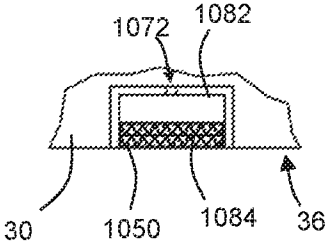
Figure 16G:
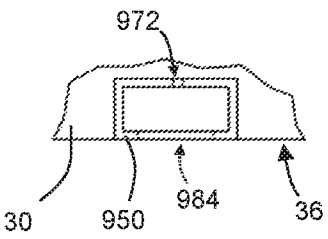
Figures 17A, 17B, 17C, 17D, 17E:
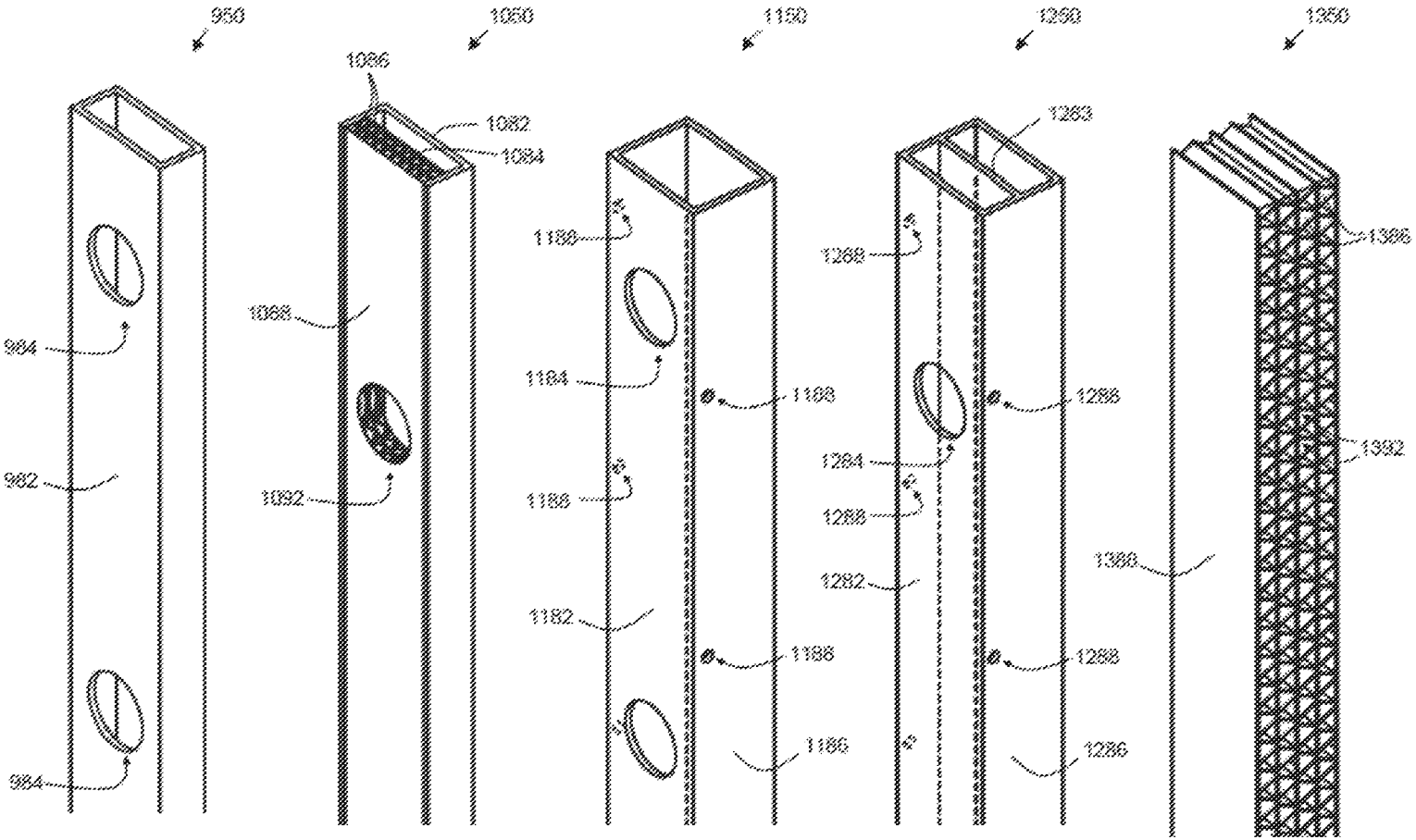
FIGS. 17A to 17E are perspective views of portions of the structural elements of FIGS. 16G to 16K, respectively.

FIGS. 16G and 17A show another embodiment of a structural element forming part of the concrete form panel 22, 222 or 322, and which is generally indicated by reference numeral 950. Structural element 950 is generally similar to structural element 550 described above and with reference to FIG. 16C, and has a generally tubular, box-shaped cross section comprising an outwardly-facing surface 982. The outwardly-facing surface 982 has a plurality of spaced apertures 984 formed therein, which provide access to ties 24 and fasteners 76. As will be understood, the outwardly-facing surface 982 also provides a fastening surface for wall finishing materials 972, such as drywall sheets or siding panels.

FIGS. 16H and 17B show another embodiment of a structural element forming part of the concrete form panel 22, 222 or 322, and which is generally indicated by reference numeral 1050. Structural element 1050 is generally similar to structural element 50 described above and with reference to FIG. 9A, and comprises a first portion 1082 having a generally C-shaped cross section that is fabricated of a material having suitable strength, such as steel or another metal, or plastic. Similar to structural element 50, the first portion 1082 has apertures 1072 formed therein for accommodating ties 24. The structural element 1050 further comprises a second portion 1084 joined or bonded to an opening of the first portion 1082, and which is fabricated of at least one corrugated layer 1086 of a material having suitable strength, such as plastic, and for example high density polyethylene (HDPE), polypropylene (PP) or acrylonitrile butadiene styrene (ABS). In the example shown, the second portion 1084 comprises two (2) layers 1086 of the corrugated material, with each layer 1086 comprising a sinusoidal or zig-zag configuration of sheet material sandwiched between two generally planar sheets of material. The second portion 1084 has an outwardly-facing surface 1088 with a plurality of spaced apertures 1092 formed therein, which provide access to ties 24 and fasteners 76. As will be understood, the outwardly-facing surface 1088 also provides a fastening surface for wall finishing materials (not shown), such as drywall sheets or siding panels. As will also be understood, the surfaces of the sinusoidal or zig-zag configuration of sheet material sandwiched between two generally planar sheets provide multiple gripping surfaces for fasteners used to fasten the wall finishing materials to the structural element 1050, which advantageously allows the wall finishing materials to be more strongly fastened.

Figure 16K:
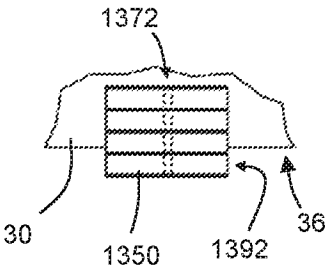
Figure 16J:
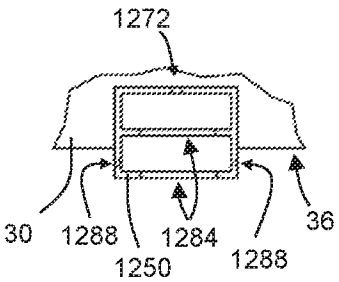
Figure 16I:
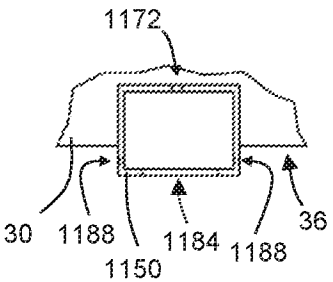

FIGS. 16I and 17C show another embodiment of a structural element forming part of the concrete form panel 22, 222 or 322, and which is generally indicated by reference numeral 1150. Structural element 1150 is generally similar to structural element 950 described above and with reference to FIGS. 16G and 17A, and has a generally tubular, box-shaped cross section comprising an outwardly-facing surface 1182. The outwardly-facing surface 1182 has a plurality of spaced apertures 1184 formed therein, which provide access to ties 24 and fasteners 76. The structural element 1150 also has apertures 1172 formed therein for accommodating ties 24. As will be understood, the outwardly-facing surface 1182 also provides a fastening surface for wall finishing materials (not shown), such as drywall sheets or siding panels. Additionally, the structural element 1150 has a depth, defined by each sidewall 1186, which is greater than the depth of the slot 48 formed in the foam body 30. When the structural element 1150 is accommodated in the slot 48, a portion of the structural element 1150 protrudes beyond the outward-facing surface 36. As a result, any finishing material (not shown), such as drywall sheets or siding panels, fastened to the structural element 1150 will advantageously be spaced from the outward-facing surface 36 of the foam body 30.

Additionally, the structural element 1150 has a plurality of apertures 1188 formed in the sidewalls 1186, in the portion of the structural element 1150 that protrudes beyond the outward-facing surface 36. As will be understood, the apertures 1188 advantageously allow for ventilation in a generally lateral direction between the concrete form panel 22 and the finishing material. In the example shown, the positions of the apertures 1188 on opposite sidewalls 1186 are staggered, such that the apertures 1188 define diagonal flow passages through the interior of the structural element 1150, relative to the length of the structural element 1150. However, it will be understood that the positions of the apertures 1188 on opposite sidewalls 1186 may alternatively be aligned, such that such that the apertures 1188 define perpendicular flow passages through the interior of the structural element 1150, relative to the length of the structural element 1150.

FIGS. 16J and 17D show another embodiment of a structural element forming part of the concrete form panel 22, 222 or 322, and which is generally indicated by reference numeral 1250. Structural element 1250 is generally similar to structural element 1150 described above and with reference to FIGS. 16I and 17C, and has a generally tubular, box-shaped cross section comprising an outwardly-facing surface 1282, but further has at least one internal stiffening rib 1283 extending the length of the structural element 1250. The outwardly-facing surface 1282 and the at least one stiffening rib 1283 have a plurality of spaced apertures 1284 formed therein, which provide access to ties 24 and fasteners 76. The structural element 1250 also has apertures 1272 formed therein for accommodating ties 24. As will be understood, the outwardly-facing surface 1282 also provides a fastening surface for wall finishing materials (not shown), such as drywall sheets or siding panels. Additionally, the structural element 1250 has a depth, defined by each sidewall 1286, which is greater than the depth of the slot 48 formed in the foam body 30. When the structural element 1250 is accommodated in the slot 48, a portion of the structural element 1250 protrudes beyond the outward-facing surface 36. As a result, any finishing material (not shown), such as drywall sheets or siding panels, fastened to the structural element 1250 will advantageously be spaced from the outward-facing surface 36 of the foam body 30.

Additionally, the structural element 1250 has a plurality of apertures 1288 formed in the sidewalls 1286, and in the portion of the structural element 1250 that protrudes beyond the outward-facing surface 36. As will be understood, the apertures 1288 advantageously allow for ventilation in a generally lateral direction between the concrete form panel 22 and the finishing material. In the example shown, the positions of the apertures 1288 on opposite sidewalls 1286 are staggered, such that the apertures 1288 define diagonal flow passages through the interior of the structural element 1250, relative to the length of the structural element 1250. However, it will be understood that the positions of the apertures 1288 on opposite sidewalls 1286 may alternatively be aligned, such that such that the apertures 1288 define perpendicular flow passages through the interior of the structural element 1250, relative to the length of the structural element 1250.

FIGS. 16K and 17E show another embodiment of a structural element forming part of the concrete form panel 22, 222 or 322, and which is generally indicated by reference numeral 1350. Structural element 1350 is generally similar to structural element 350 described above and with reference to FIG. 14A, but is fabricated of a plurality of corrugated layers 1386 of a material having suitable strength, such as plastic, and for example high density polyethylene (HDPE), polypropylene (PP) or acrylonitrile butadiene styrene (ABS). In the example shown, the structural element 1350 comprises four (4) layers 1386 of the corrugated material, with each layer 1386 comprising a sinusoidal or zig-zag configuration of sheet material sandwiched between two generally planar sheets of material, as is known in the art. The structural element 1350 has an outwardly-facing surface 1388, which also provides a fastening surface for wall finishing materials (not shown), such as drywall sheets or siding panels. As will be understood, the surfaces of the sinusoidal or zig-zag configuration of sheet material sandwiched between two generally planar sheets provide multiple gripping surfaces for fasteners used to fasten the wall finishing materials to the structural element 1350. The structural element 1350 has a depth that is greater than the depth of the slot 48 formed in the foam body 30. When the structural element 1350 is accommodated in the slot 48, a portion of the structural element 1350 protrudes beyond the outward-facing surface 36. As a result, any finishing material (not shown), such as drywall sheets or siding panels, fastened to the structural element 1350 will advantageously be spaced from the outward-facing surface 36 of the foam body 30. Similar to structural element 50, the structural element 1350 has apertures 1372 formed therein for accommodating ties 24.

As will be understood, the corrugated structure of the structural element 1350 advantageously enables ventilation in a generally lateral direction between the concrete form panel 22 and the finishing material. In the example shown, the corrugations in each layer 1386 define a plurality of flow passages 1392 that traverse the width of the structural element 1350, and that are oriented generally perpendicularly to the length of the structural element 1350. However, it will be understood that the corrugations in each layer 1386 may alternatively be oriented diagonally relative to the length of the structural element 1350. The structural element 1350 may for example be a furring strip fabricated by Quarrix Building Products, a subsidiary of Liberty Diversified International of Minneapolis, U.S.A., and as described in U.S. Pat. Nos. 6,938,383 and 7,117,649.

Figure 18:
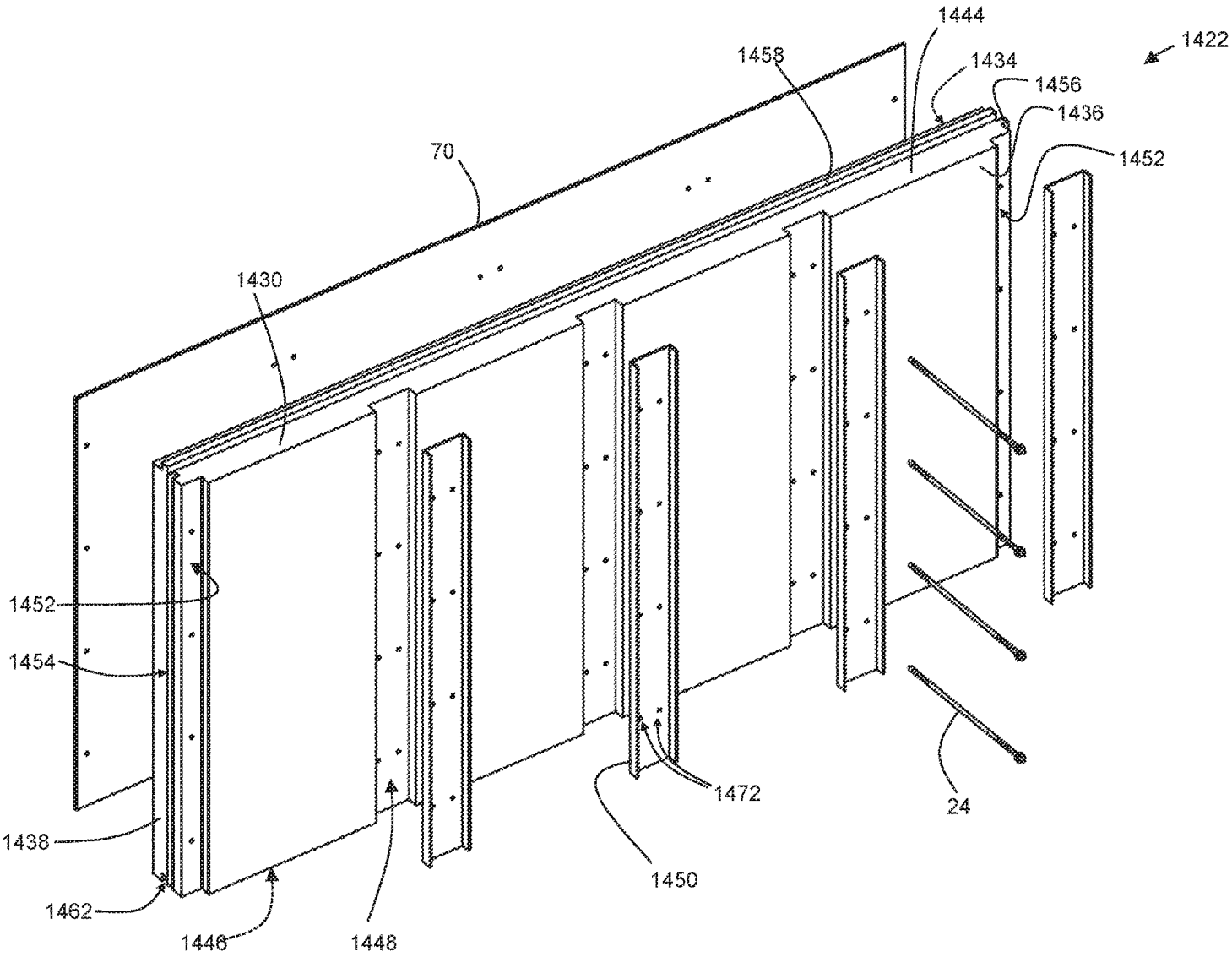
FIG. 18 is an exploded perspective view of still another embodiment of a concrete form panel for use with the concrete formwork of FIG. 1 or FIG. 12.

FIG. 18 shows another embodiment of a concrete form panel for use with the concrete formwork 20 or 120, and which is generally indicated by reference numeral 1422. Concrete form panel 1422 is generally similar to concrete form panel 22 described above and with reference to FIGS. 2 to 8, and has a foam body 1430 fabricated of insulating foam, which in this embodiment is fabricated of expanded polystyrene (EPS) foam by molding. The foam body 1430 has a generally planar concrete-facing surface 1434, an outward-facing surface 1436 opposite the concrete-facing surface 1434, a first lateral surface 1438, a second lateral surface 1442, a top surface 1444 and a bottom surface 1446. The foam body 1430 has a plurality of connecting features formed therein for enabling abutting concrete form panels 1422 to be connected. In the example shown, the connecting features comprise a groove 1454 formed in the first lateral surface 1438, a tongue 1456 formed on the second lateral surface 1442, a tongue 1458 formed on the top surface 1444, and a groove 1462 formed in the bottom surface 1446. In the example shown, the foam body 1430 has a length of eight (8) feet, a height of four (4) feet and a thickness of six (6) inches, however it will be understood that the foam body 1430 may alternatively be differently dimensioned.

In this embodiment, the foam body 1430 has a plurality of slots 1448 and 1452 formed in the outward-facing surface 1436, with each slot 1448 being sized to accommodate a structural element 1450, and with each slot 1452 being formed at the edge of the outward-facing surface 1436 and having half (½) the width of a slot 1448. In the example shown, the slots 1448 have a pitch of two (2) feet, however it will be understood that the foam body 1430 may alternatively be differently dimensioned.

Each structural element 1450 has a generally C-shaped cross section, and has apertures 1472 formed therein for accommodating ties 24. The structural element 1450 is fabricated of a material having suitable strength, such as steel or another metal, or plastic. The structural elements 1450 are bonded to the slots 1448 and 1452 formed in the foam body 30 by adhesive (not shown). In the example shown, the structural element 1450 has a length of four (4) feet, a width of four (4) inches and a depth of one (1) inch, however it will be understood that the structural element 1450 may alternatively be differently dimensioned.

As will be understood, when two (2) concrete form panels 1422 abut horizontally, the adjoining slots 1452 combine to provide a slot that is sized to accommodate one (1) structural element 1450. As will be understood, when ties 24 are passed through apertures 72 of a structural element 1450 accommodated by two adjoining slots 1452, the abutting concrete form panels 1422 advantageously become fastened together by the structural element 1450 and the ties 24.

The concrete form panel 1422 also comprises the film 1470, which is disposed on the concrete-facing surface 1434 of the foam body 1430. In this embodiment, the film 70 is disposed on the concrete-facing surface 34 during molding of the foam body 1430, whereby the film 70 is positioned in the mold and becomes affixed to the foam body 1430 during molding. During use, concrete poured into the volume 28 comes into contact with the film 70 and sets within the concrete formwork 20. The film 70 and the foam body 1430 are configured such that the interfacial strength between the film 70 and the foam body 1430 is greater than the adhesive strength between the film 70 and the set concrete.

Figure 19C:
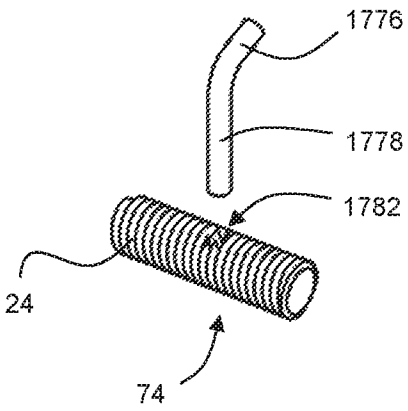
FIGS. 19A to 19C are perspective views of other embodiments of fasteners for use with the tie of FIG. 9A.
Figure 19B:
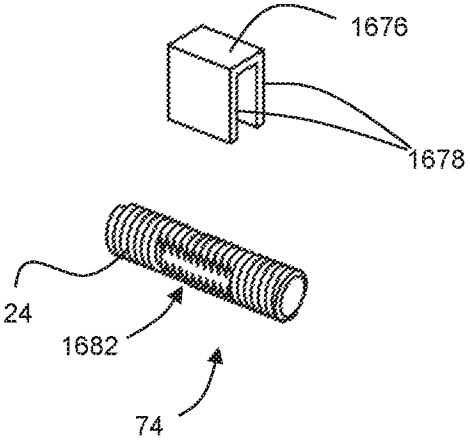
Figure 19A:
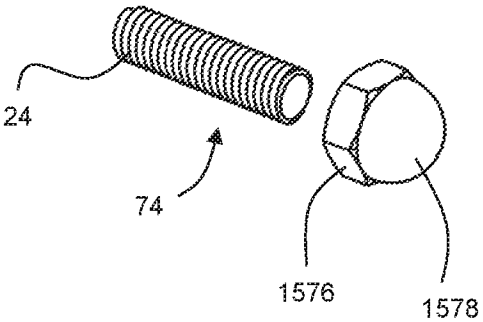

In other embodiments, the fasteners may be differently configured. For example, although in the embodiment described above, the fastener is a threaded nut, in other embodiments, other fasteners may be used. FIG. 19A shows another embodiment of a fastener for use with the concrete form panel 22, and which is generally indicated by reference numeral 1576. Fastener 1576 is in the form of a threaded hemispherical connector, and comprises a hemispherical cap 1578 enclosing a threaded cavity (not shown) that is configured to threadably engage the threaded end 74 of the tie 24. As will be understood, the threaded hemispherical connector is not limited to the exact configuration shown and may alternatively be differently configured. For example, the threaded hemispherical connector may alternatively have a larger outer diameter for enabling the threaded hemispherical connector to be more easily fastened and unfastened by hand. As another example, FIG. 19B shows another embodiment of a fastener for use with the concrete form panel 22, and which is generally indicated by reference numeral 1676. Fastener 1676 is in the form of a U-shaped clip fabricated of a resilient material, and has two (2) prongs 1678 that are configured to engage slots 1682 formed in the threaded end 74 of the tie 24. FIG. 19C shows still another embodiment of a fastener for use with the concrete form panel 22, and which is generally indicated by reference numeral 1776. Fastener 1776 is in the form of a pin, and has a shaft 1778 that is configured to engage a aperture 1782 formed through the threaded end 74 of the tie 24. As will be appreciated, fasteners 1576, 1676 and 1776 are each connectable to the tie 24 manually and without the use of tools, which advantageously reduces the amount of labour required to assemble the concrete formwork 20 or 120.

Although in the embodiments described above, the foam body of the concrete form panel is fabricated of EPS foam, in other embodiments, the concrete form panel may alternatively be fabricated of another suitable foam material, such as for example extruded polystyrene (XPS) foam.

Although in the embodiments described above, the foam body of the concrete form panel is formed by molding, in other embodiments, the foam body may alternatively be formed by cutting the foam body from a larger block of already-molded foam, such as EPS foam, XPS foam, and the like.

Although in the embodiments described above, the film 70 is disposed on the concrete-facing surface during molding of the foam body, whereby the film 70 is positioned in the mold and becomes affixed to the foam body during molding, in other embodiments, the film 70 may alternatively be disposed on the foam body after molding. For example, the film may alternatively be affixed to the concrete-facing surface by an adhesive layer, such as a glue layer, disposed between the film 70 and the concrete-facing surface of the foam body. In one such embodiment, the film 70 and glue layer may alternatively be provided on a disposable backing layer, and peeled from the backing layer and applied to the concrete-facing surface of the foam body. In other embodiments, the film may alternatively comprise two (2) or more layers of different plastic, with a first layer being polypropylene, polyester and the like, and a second layer being a plastic having a low glass transition temperature ($T_g$) (sometimes referred to as a "melting point"), such as polyethylene. In this embodiment, the film is affixed to the foam body by heating the film using a suitable tool, such as a hot air gun, a heater, an iron, a hot plate, and the like, so as soften or "melt" the low $T_g$ layer. The softened or "melted" low Tg layer forms an adhesive layer, and thereby cause the first layer to adhere and become affixed to the foam body.

Although in the embodiments described above, the foam body has connecting features formed therein for enabling abutting concrete form panels to be connected, with the connecting features comprising a groove formed in the first lateral surface, a tongue formed on the second lateral surface, a tongue formed on the top surface, and a groove formed in the bottom surface, it will be understood that the connecting features are merely exemplary in shape and number, and other shapes and numbers of connecting features may alternatively be used. In other embodiments, the lateral surfaces, and/or the top and bottom surfaces, may alternatively have no connecting features formed thereon or therein, and may alternatively be generally planar surfaces.

Although in the embodiments described above, the foam body has a plurality of slots formed therein and the structural elements are bonded to the slots by adhesive, in other embodiments, the structural elements may alternatively not be bonded by adhesive and may instead be applied to and held against the foam body using the ties and fasteners. In other embodiments, the structural elements may alternatively be held in the slots by interference fit. For example, in one such embodiment, the slots may alternatively be sized smaller than the structural elements, so as to retain the structural elements by interference fit. In other embodiments, the foam body may have inwardly-extending grooves or other features formed therein adjacent the slots, and the structural elements may further comprise outwardly-extending tabs for engaging the grooves by interference fit. In still other embodiments, the foam body may alternatively be molded with the structural elements embedded therein, with the embedded structural elements being accessible from the concrete-facing surface of the foam body.

Although in embodiments described above, the concrete form panel comprises a film 70 disposed on the concrete-facing surface of the foam body, in other embodiments, the concrete form panel may alternatively also comprise a film 70 disposed on the outward-facing surface of the foam body, opposite the concrete-facing surface.

Although in the embodiments described above, each tie 24 is in the form of a steel rod having threaded ends for each engaging a fastener in the form of a threaded nut, in other embodiments, the tie and fastener may alternatively be differently configured. For example, in one embodiment, each tie may alternatively comprise two (2) or more connectable components which when connected provide a tie. As another example, in another embodiment, the tie and fasteners may alternatively be a single bolt and one fastener. Those skilled in the art will understand that still other configurations are possible. The tie may alternatively by fabricated of a suitable material other than steel, such as another metal or plastic.

Although in embodiments described above, the structural element has a plurality of apertures formed in the sidewalls, in the portion of the structural element that protrudes beyond the outward-facing surface, for allowing ventilation in a generally lateral direction between the concrete form panel and the finishing material, in other embodiments, the structural element may alternatively have only a single aperture, or a single elongate or slot-shaped opening, formed in each sidewall in the portion of the structural element that protrudes beyond the outward-facing surface, both of which thereby define only a single flow passage through the structural element.

Although embodiments have been described above with reference to the accompanying drawings, those of skill in the art will appreciate that variations and modifications may be made without departing from the scope thereof as defined by the appended claims.

What is claimed is:

1. A concrete form panel for a concrete formwork, the concrete form panel comprising:

a foam body having a concrete-facing surface and an outward-facing surface opposite the concrete-facing surface, the outward-facing surface having a plurality of slots formed therein;

a plurality of structural elements, each structural element having a generally C-shaped cross section having an outward-facing opening, each structural element being accommodated in a respective slot, each structural element having apertures formed therein for accommodating ties; and additional slots formed at edges of the outward-facing surface, each additional slot being sized to accommodate a portion of one of the structural elements.

2. The concrete form panel of claim 1, wherein each slot extends:

at least a portion of the height of the foam body, or at least a portion of the length of the foam body.

3. The concrete form panel of claim 1, wherein each slot extends the height or the length of the foam body.

4. The concrete form panel of claim 1, wherein each structural element is bonded by adhesive to the foam body.

5. The concrete form panel of claim 1, wherein each structural element is sized to have an outward-facing surface that is flush with the outward-facing surface of the foam body.

6. The concrete form panel of claim 1, wherein the structural element is sized such that it protrudes beyond the outward-facing surface of the foam body.

7. The concrete form panel of claim 6, wherein each structural element has an outward-facing surface that is offset from the outward-facing surface of the foam body.

8. The concrete form panel of claim 7, wherein each structural element has a plurality of additional apertures formed in sidewalls thereof, the additional apertures defining a plurality of ventilation passages through the structural element.

9. The concrete form panel of claim 7, wherein each structural element has an additional aperture formed in each sidewall thereof, the additional apertures defining a single ventilation passage through the structural element.

10. The concrete form panel of claim 1, wherein each structural element comprises at least one layer of corrugated material.

11. The concrete form panel of claim 10, wherein corrugations of the at least one layer of corrugated material define a plurality of ventilation passages through the structural element.

12. The concrete form panel of claim 1, further comprising a film disposed on the concrete-facing surface.

13. The concrete form panel of claim 12, wherein an interfacial strength between the film and the foam body is greater than the adhesive strength between the film and set concrete.

14. The concrete form panel of claim 12, wherein the film is a film of plastic.

15. The concrete form panel of claim 12, further comprising an adhesive layer disposed between the film and the foam body.

16. A concrete formwork, comprising:

a plurality of panels defining spaced, opposing sides of the formwork, at least some of the panels being concrete form panels each comprising:

a foam body having a concrete-facing surface and an outward-facing surface opposite the concrete-facing surface, the outward-facing surface having a plurality of slots formed therein, a plurality of structural elements, each structural element having a generally C-shaped cross section having an outward-facing opening, each structural element being accommodated in a respective slot and contacting only surfaces of the slot, and each structural element having apertures formed therein for accommodating ties, and a film disposed on the concrete-facing surface, an interfacial strength between the film and the foam body being greater than the adhesive strength between the film and set concrete; and a plurality of ties accommodated by the structural elements and connecting the panels of the opposing sides of the formwork.

17. The concrete formwork of claim 16, wherein the panels defining both sides of the formwork are the concrete form panels.

18. The concrete formwork of claim 16, wherein the panels defining a first side of the formwork are the concrete form panels, and the panels defining a second side of the formwork are hardboard sheets.

19. A method of forming a concrete wall, comprising:

stacking a plurality of panels to define spaced, opposing sides of a formwork, at least some of the panels being concrete form panels each comprising:

a foam body having a concrete-facing surface and an outward-facing surface opposite the concrete-facing surface, the outward-facing surface having a plurality of slots formed therein, a plurality of structural elements, each structural element having a generally C-shaped cross section having an outward-facing opening, each structural element being accommodated in a respective slot and contacting only surfaces of the slot, and each structural element having apertures formed therein for accommodating ties, and a film disposed on the concrete-facing surface, an interfacial strength between the film and the foam body being greater than the adhesive strength between the film and set concrete;

connecting opposing panels with a plurality of ties accommodated in the structural elements; and pouring concrete into the volume defined between the opposing sides of the formwork.

* * * * *